US011261619B2

(12) United States Patent
Liu

(10) Patent No.: US 11,261,619 B2
(45) Date of Patent: Mar. 1, 2022

(54) LOCK WITH A ROLLER DEADBOLT

(71) Applicant: FEDERAL LOCK CO., LTD., Pingtung County (TW)

(72) Inventor: Tien-Kao Liu, Pingtung County (TW)

(73) Assignee: Federal Lock Co., Ltd., Pingtung County (TW)

( * ) Notice: Subject to any disclaimer, the term of this patent is extended or adjusted under 35 U.S.C. 154(b) by 596 days.

(21) Appl. No.: 16/292,758

(22) Filed: Mar. 5, 2019

(65) Prior Publication Data

US 2020/0157843 A1 May 21, 2020

(30) Foreign Application Priority Data

Nov. 16, 2018 (TW) ..... 107140863

(51) Int. Cl.
*E05B 15/10* (2006.01)
*E05B 59/00* (2006.01)
(Continued)

(52) U.S. Cl.
CPC ..... *E05B 15/102* (2013.01); *E05B 9/02* (2013.01); *E05B 59/00* (2013.01); *E05C 1/08* (2013.01);
(Continued)

(58) Field of Classification Search
CPC ..... E05B 55/00; E05B 63/0056; E05B 63/08; E05B 63/10; E05B 63/16; E05B 63/18; E05B 63/185; E05B 63/20; E05B 15/0013; E05B 15/0033; E05B 15/04; E05B 2015/0448; E05B 9/02; E05B 59/00; E05B 15/10; E05B 15/102; E05B 15/104;
(Continued)

(56) References Cited

U.S. PATENT DOCUMENTS 4,993,757 A * 2/1991 Corzine ..... E05B 47/0002 292/144
6,651,466 B1 * 11/2003 Shih ..... E05B 63/044 292/165
(Continued)

FOREIGN PATENT DOCUMENTS

AU 2010226865 A1 * 4/2011 ..... E05B 59/00
DE 1553564 A1 * 5/1970 ..... E05C 19/04
(Continued)

*Primary Examiner* — Kristina R Fulton
*Assistant Examiner* — Tal Saif
(74) *Attorney, Agent, or Firm* — Rosenberg, Klein & Lee

(57) ABSTRACT

A lock with a roller deadbolt includes a driving member having a first slot and a transverse slot. The driving member is connected to a first spring, a second spring and a positioning rod. A deadbolt includes a body, an insertion member, a roller and a slide. The driving member is connected to the body. The insertion member is received in the body. The second spring biases the insertion member. The slide is restricted by the positioning rods of the driving member and has a first guide pin extending through the first slot. The slide is movable along the first slot. The guide hole includes an extension slot and an inclined slot which inclinedly communicates with the extension slot. When in a non-transmission position, the roller protrudes beyond the receiving space. When in the transmission position, the roller does not protrude beyond the receiving space.

9 Claims, 36 Drawing Sheets

(51) Int. Cl.
*E05C 1/08* (2006.01)
*E05B 9/02* (2006.01)

(52) U.S. Cl.
CPC ... *E05B 2015/107* (2013.01); *E05Y 2900/132* (2013.01)

(58) Field of Classification Search
CPC .. E05B 15/108; E05B 2015/107; E05B 17/04; E05B 17/047; E05B 17/20; E05B 17/2007–208; E05B 63/06; E05B 63/202; E05C 1/02; E05C 1/06; E05C 1/08; E05C 1/085; E05C 1/12; Y10T 292/0834; Y10T 292/0836; Y10T 292/0837; Y10T 292/0839; Y10T 292/084; Y10T 292/0844; Y10T 292/0989; Y10T 292/0808; Y10T 292/0824; E05Y 2900/132
See application file for complete search history.

(56) References Cited

U.S. PATENT DOCUMENTS 7,007,985 B2 * 3/2006 Alexander ..... E05B 59/00 292/163
7,836,738 B2 * 11/2010 Tien ..... E05B 13/004 70/149
8,371,627 B2 * 2/2013 Chiang ..... E05B 55/06 292/164
8,641,104 B1 * 2/2014 Tien ..... E05B 63/16 292/244
2006/0185405 A1 * 8/2006 Middleton ..... E05B 63/0021 70/134
2009/0151407 A1 * 6/2009 Lin ..... E05B 63/20 70/107
2016/0047143 A1 * 2/2016 Shiu ..... E05B 17/22 70/101
2016/0060905 A1 * 3/2016 Shiu ..... E05C 1/08 292/33
2017/0275918 A1 * 9/2017 Colligan ..... E05B 17/0045

FOREIGN PATENT DOCUMENTS

DE 2525771 A1 * 12/1976 ..... E05B 63/0021
DE 3143710 A1 * 5/1983 ..... E05B 63/0017
DE 20021665 U1 * 2/2001 ..... E05B 59/00
EP 0271779 A2 * 6/1988 ..... E05B 17/007
EP 0495736 A1 * 7/1992 ..... E05B 59/00
EP 0575660 A2 * 12/1993 ..... E05B 63/0069
EP 0633377 A1 * 1/1995 ..... E05B 59/00
EP 1580361 A1 * 9/2005 ..... E05B 55/12
GB 2400135 A * 10/2004 ..... E05B 63/06
GB 2430005 A * 3/2007 ..... E05B 63/0021
GB 2466665 A * 7/2010 ..... E05B 63/044
WO WO-9966155 A1 * 12/1999 ..... E05B 47/063
WO WO-2014016854 A1 * 1/2014 ..... E05B 15/10

* cited by examiner

LOCK WITH A ROLLER DEADBOLT

BACKGROUND OF THE INVENTION

1. Fields of the Invention

The present invention relates to a lock with a roller-type deadbolt, and more particularly, to a lock deadbolt has a roller connected thereto to prevent from being injury due to impact with the deadbolt, or from damaging the latch, and to prevent from being locked inside due to unintentionally shut the door.

2. Descriptions of Related Art

A lock is installed to a door, and the lock is controlled to be locked and unlocked to obtain safety and privacy features.

The door lock usually includes a latch bolt and a deadbolt, wherein the latch bolt is operated by operation to the handles, while the deadbolt has to be operated by operation to the core of the lock. For doors of storage rooms or plants, in order to prevent being locked inside of the door due to unintentionally shut the door, or to prevent from unlocking repeatedly, this type of door locks usually do not have the latch bolt, and only the deadbolt is available. However, even though the door is not affected by the deadbolt during in and out of users via the room, when the door is applied by a force and closed, the users have to pull the door to open it. This may affect the transportation work. Therefore, the users set the deadbolt to protrude beyond the case a distance so that the deadbolt will be stopped by the door frame to prevent the door to be closed. The deadbolt usually is a rectangular part which may hurt the users due to impact, or the deadbolt is broken by frequent impact. Therefore, the existed locks for doors of storage rooms and plants need to be improved.

The present invention is intended to provide a lock to eliminate the drawbacks mentioned above.

SUMMARY OF THE INVENTION

The present invention relates to a lock with a roller deadbolt, and comprises a driving member having a first slot and a transverse slot. The driving member further includes two channels defined in the distal end thereof. The driving member is connected to a first spring, a second spring and at least one positioning rod, wherein the first spring is located corresponding to the first slot. A deadbolt includes a body, an insertion member, a roller and a slide. The body includes a fixing slot to which the distal end of the driving member is connected. The body includes a receiving space located corresponding to one end of the driving member. The body includes at least one fixing hole which communicates with the fixing slot. The insertion member is received in the fixing hole and includes two connection portions which are respectively inserted into the channels. An accommodating room is formed between the two connection portions so as to receive the roller therein. A pin extends through the roller, and the two ends of the pin are fixed with the two through holes. The insertion member includes a guide rod protruding therefrom which is located corresponding to the transverse slot. The second spring biases an end face of the insertion member that is located opposite to the roller. The slide is restricted by the positioning rods. The slide includes a first guide pin and a guide hole, wherein the first guide pin extends through the first slot. The slide includes an inclined surface. The first spring biases the inclined surface so that the slide is movable along the first slot. The guide hole includes an extension slot and an inclined slot, wherein the extension slot is located at the top end of the guide hole and located corresponding to the transverse slot. The inclined slot communicates with the extension slot and inclinedly extends toward a direction away from the roller. The slide has a transmission rod extending toward a direction away from the roller. When in a non-transmission position, the slide is biased by the first spring so that the first guide pin is located an inner bottom end of the first slot. The insertion member is biased by the second spring and the roller protrudes beyond the receiving space. When in the transmission position, the transmission rod is pushed so that the slide and the inclined slot move toward the top of the first slot. The guide rod contacts the inclined slot to drive the slide and the roller to move along the transverse slot and toward a direction opposite to the roller. The roller does not protrude beyond the receiving space.

Preferably, the driving member has a second slot which is located corresponding to the first slot. The slide has a second guide pin which is movable in the second slot.

Preferably, the slide includes a first receiving notch defined in the bottom thereof. An extension portion extends from the top of the slide. A second receiving notch is formed at the lower end of the extension portion. The at least one positioning rod is engaged with the first receiving notch. The at least one positioning rod is located at the first receiving notch, a lateral side of the extension portion that faces the roller, and the second receiving notch when in the non-transmission position.

Preferably, the fixing slot includes at least one guide way which is located at a path that the roller moves between the non-transmission position and the transmission position. The insertion member includes ridges which slide on the at least one guide way.

Preferably, the present invention further comprises a case which includes a core recess and a deadbolt recess. The core recess includes a first guide member and defines a loop-shaped rail. The transmission rod is located at the rail when the deadbolt does not protrudes beyond the deadbolt recess. The deadbolt is movable in the deadbolt recess. The driving member includes a third notch defined in one end thereof. The transmission rod and the third notch are located at the loop-shaped rail.

Preferably, the core recess includes the first guide member, a restriction plate and a stop plate. The underside of the restriction plate is located at the rail. The restriction plate includes a first guide hole, and the first guide member extends through the first guide hole. The case includes a third positioning wall which includes a second positioning portion formed on the underside thereof. A resilient unit is biased between the restriction plate and the third positioning wall. The resilient unit is connected to the second positioning portion, and the resilient direction of the resilient unit is correspondent to the first guide hole. The restriction plate includes at least one engaging member. The driving member has a slide slot in which the first guide member is slidably received therein. The driving member includes a third guide member on one end face thereof. The driving member includes a first notch and a second notch defined in the top thereof. The first and second notches are located corresponding to the at least one engaging member. The stop plate is pivotably connected to the third guide member and includes an extension portion which includes a corner. The extension portion includes a rod which is slidable in an elongate groove defined in one end face of the case. The corner is removed from the rail. When in a locked position, the deadbolt protrudes beyond the deadbolt recess, and the first guide member is located in one end of the slide slot and located opposite to the deadbolt. The rod is located at the top inner end of the elongate groove. The engaging member is engaged with the second notch. When in an unlocked position, the deadbolt is located in the deadbolt recess. The roller protrudes beyond the deadbolt recess. The first guide member is located is located in another end of the slide slot. The rod is located at the bottom inner end of the elongate groove. The engaging member is engaged with the first notch.

Preferably, the present invention further comprises an extension plate which has an end thereof pivotably connected to the second guide member. The extension plate includes an extension slot which extends toward two opposite extension directions which are located corresponding to the slide slot. The first guide member is slidable within the extension slot. The extension plate is located at the rail.

Preferably, the core recess includes a core received therein, and the core has a cam which is rotatable along the rail.

Preferably, the present invention further comprises a receiving box which includes a receiving hole that is located corresponding to the deadbolt. The receiving hole includes two resilient members received therein. Each receiving member includes an installation portion and a holding portion. The installation portion is connected to a wall of the receiving hole, and the holding portion is a bent portion extending toward the opening of the receiving hole. A holding room is defined between the two holing portions and located corresponding to the roller and the deadbolt.

The advantages of the present invention are that, the case pre-installs the latch bolt recess, the restriction recess, the deadbolt recess, the installation recess, the first positioning portion, the second positioning portion, the installation hole, the first positioning wall, the second positioning wall, the third positioning wall, the fourth positioning wall, the first slot, the first fixing recess, the second fixing recess, the core recess, the stop wall, the first guiding slot, the second guiding slot, the elongate groove, and the core hole. The users optionally install the latch bolt, the restriction bolt, the restriction member, the deadbolt, the top and bottom rotation members, the first resilient member, the resilient unit, the second resilient member, the third resilient member, and the core so as to allow the lock to have different functions and combinations according to practical needs. For example, using the latch bolt to lock, restriction the handles to drive the latch bolt, preventing the latch bolt from shifting from the gap of the door and door frame, locking the door by the deadbolt, the unlocking features for emergency doors, long travel distance of the deadbolt, and the deadbolt with the roller. The present invention can be used for gate doors, doors for plants, doors for storage rooms, emergency doors, doors for rooms, and doors for bath rooms. Therefore, the users do not need to purchase a brand new case of the lock, simply optionally installs or removes certain parts. For manufacturers, the present invention saves research and manufacturing cost for new locks and parts, and the cost for inventory is also reduced.

Thanks to the driving member, the body, the insertion member, the roller and the slide of the present invention, when in a non-transmission position, the slide is biased by the first spring so that the first guide pin is located an inner bottom end of the first slot. The insertion member is biased by the second spring and the roller protrudes beyond the receiving space. Under this status, a force vertically presses the roller, because the insertion member is not restricted so that the second spring is compressed to push the roller into the receiving space, so that the users simply apply a force can close or open the door. By the resilient members, the door can be prevented from being closed to affect people entering or leaving from the door, and also prevents the users from hitting the deadbolt and being injured, or even prevents the deadbolt from being broken due to the impact. When the door is closed, the resilient members prevent the door generating noise due to shaking. When in the transmission position, the transmission rod is pushed so that the slide and the inclined slot move toward the top of the first slot. The guide rod contacts the inclined slot to drive the slide and the roller to move along the transverse slot and toward a direction opposite to the roller. The roller does not protrude beyond the receiving space. This is helpful for controlling open/close of the door. Furthermore, the present invention includes a compact size and structure, and is easily assembled or dis-assembled.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
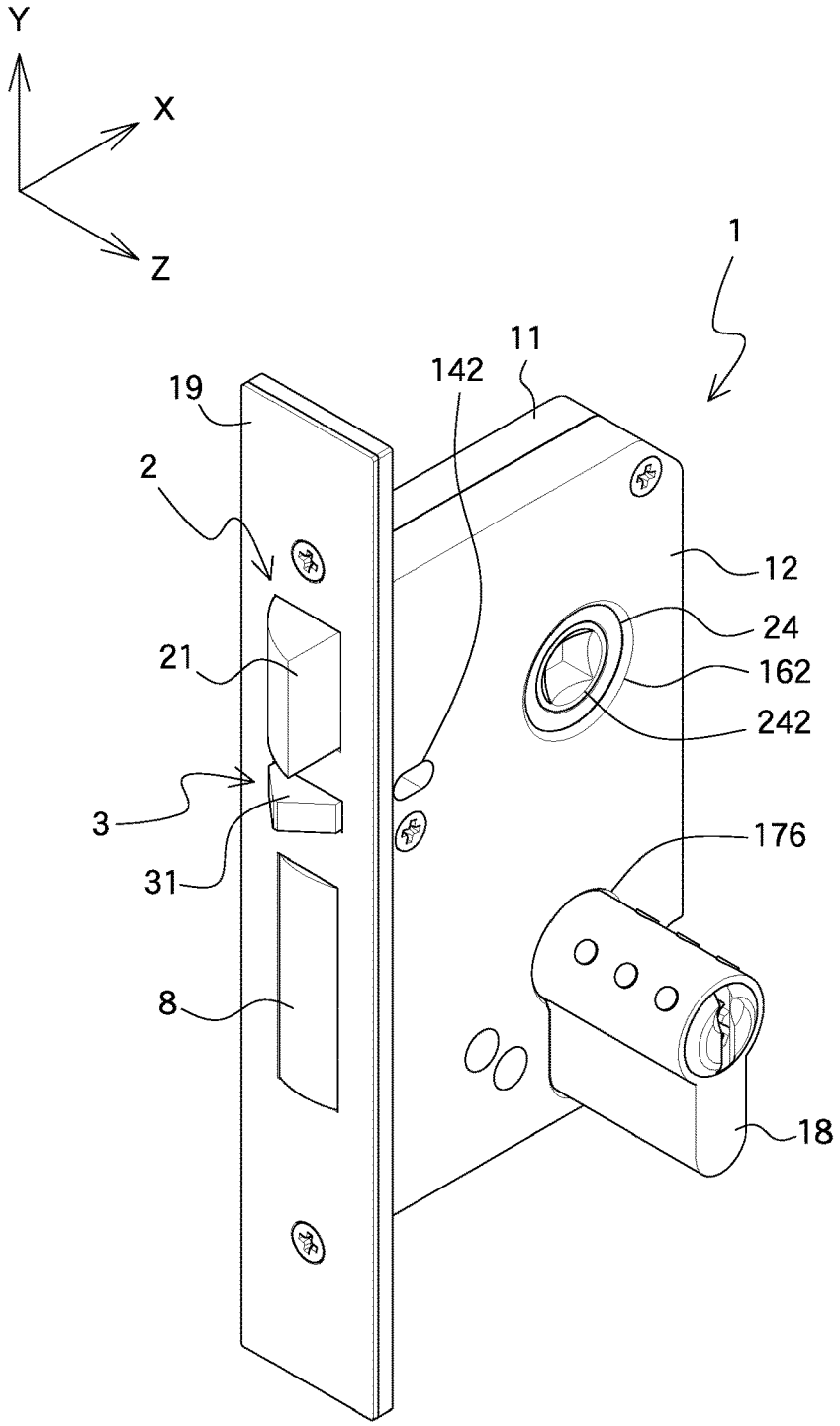
FIG. 1 is a perspective view to show the first embodiment of the lock of the present invention.
Figure 2:
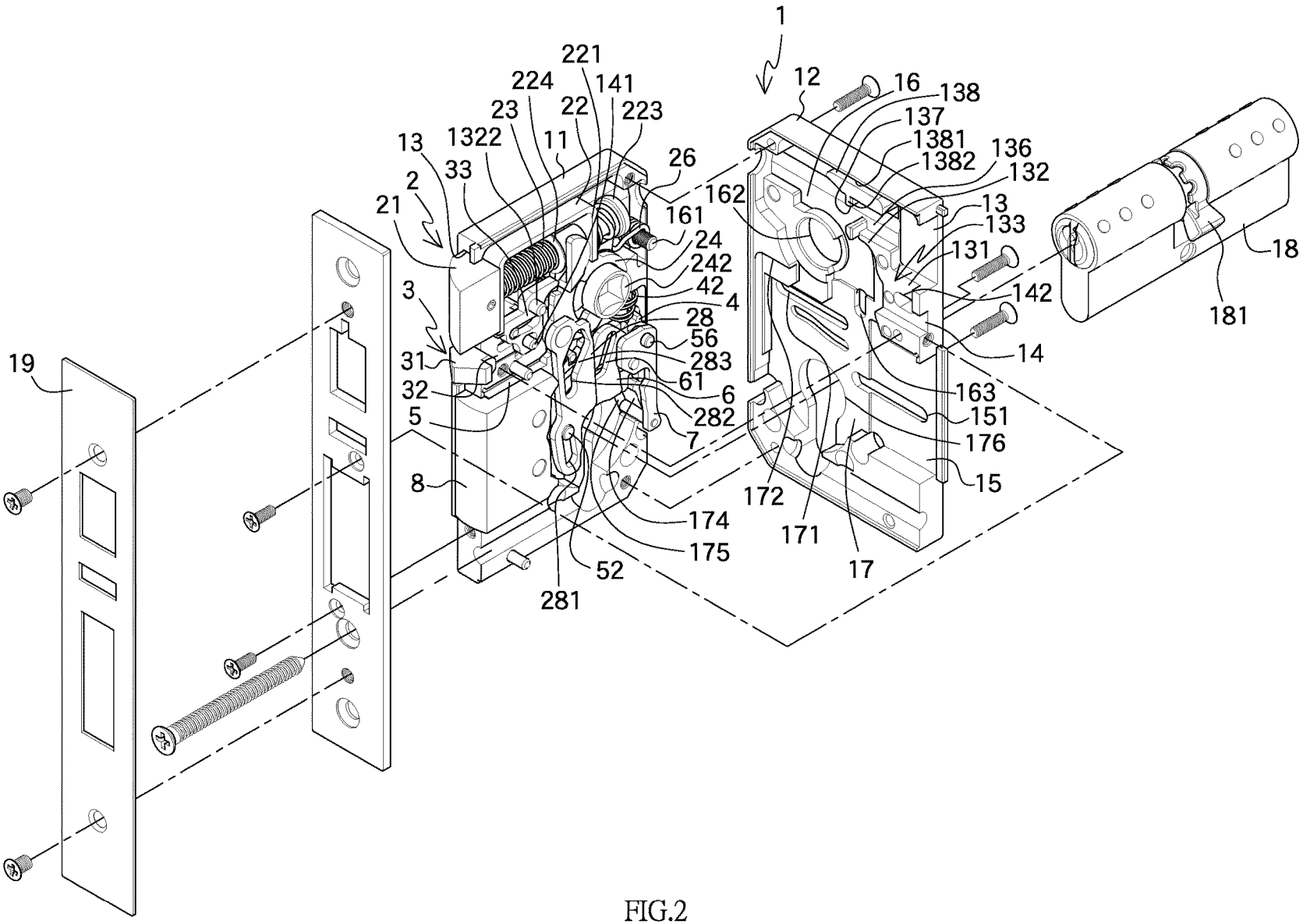
FIG. 2 is an exploded view of the first embodiment of the lock of the present invention.
Figure 3:
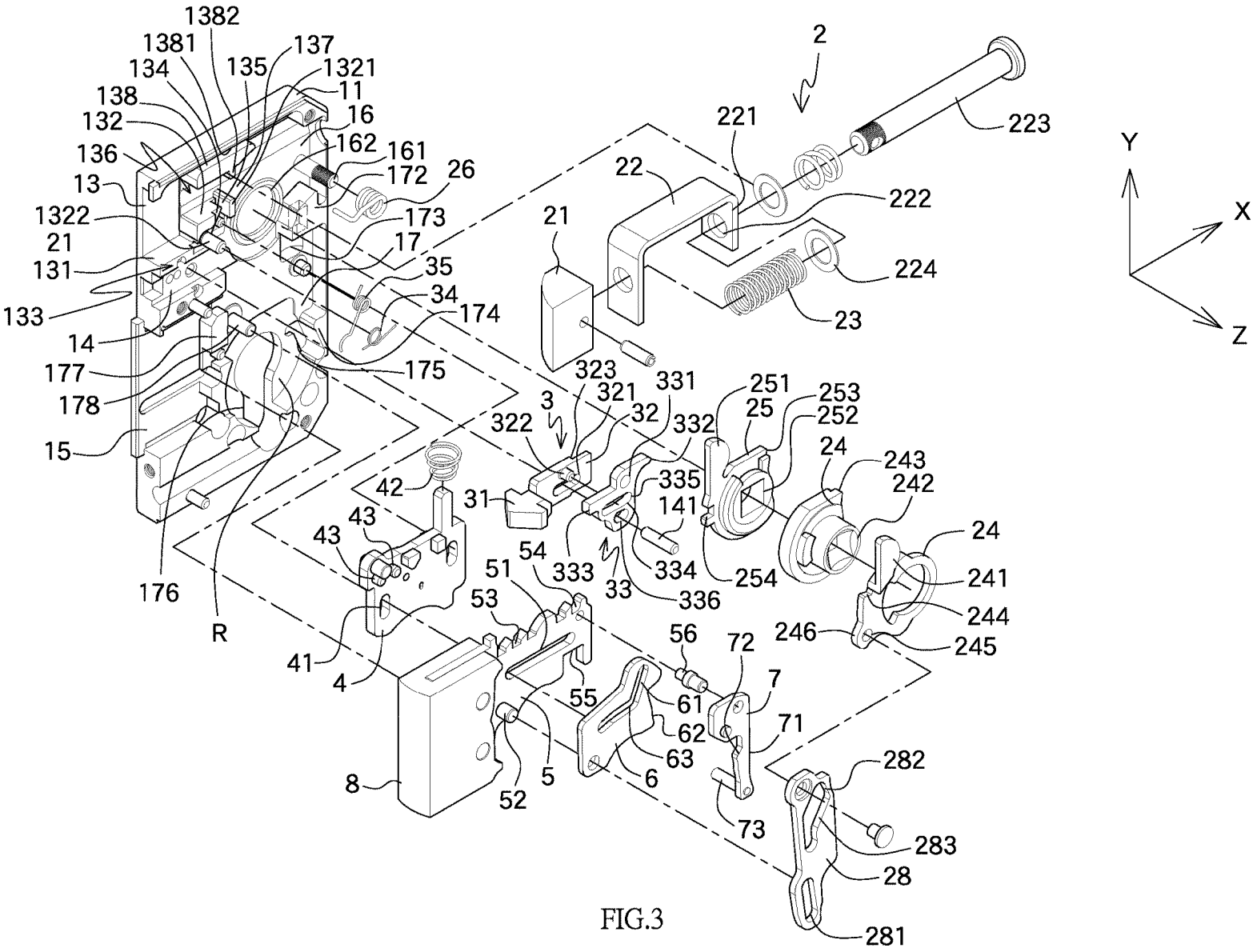
FIG. 3 is another exploded view of the first embodiment of the lock of the present invention.

Referring to FIGS. 1 to 5, the present invention provides a multiple functions and module replaceable lock, and the lock comprises a case 1 which includes a first part 11 and a second part 12 which is connected to the first part 11 to form the case 1. The case 1 is installed to a door (not shown).

The case 1 includes a latch bolt recess 13, a restriction recess 14 and a deadbolt recess 15 defined in a lateral side from top to bottom of the case 1.

The distal end of the X-axis of the latch bolt recess 13 communicates with an installation recess 16. The installation recess 16 includes a first positioning portion 161 located corresponding to the distal end of the latch bolt recess 13. The case 1 includes an installation hole 162 defined in the Z-axis thereof and located within the inner bottom of the installation recess 16. The case 1 includes a first positioning wall 131 formed at the bottom of the latch bolt recess 13. The first positioning wall 131 connects with the second positioning wall 132, and forms a first slot 133. The bottom of the latch bolt recess 13 communicates with the restriction recess 14 via the first slot 133. The distal end of the restriction recess 14 communicates with the installation recess 16. The first slot 133 further includes a first fixing recess 134 and a second fixing recess 135 defined in the second positioning wall 132.

The case 1 includes a core recess 17 defined in the distal end of the X-axis of the deadbolt recess 15, and the core recess 17 communicates with the installation recess 16. The deadbolt recess 15 includes a first guiding slot 151 defined in a wall thereof. The core recess 17 includes a second guiding slot 171 defined in a wall thereof. The core recess 17 includes a third positioning wall 172 on the top thereof, and the third positioning wall 172 includes a first positioning portion 161 on the top thereof. The third positioning wall 172 includes a second positioning portion 173 formed on the bottom thereof. The core recess 17 includes a fourth positioning wall 174 which is located corresponding one end of the third positioning wall 172. The core recess 17 includes an elongate groove 175 defined in one end of the fourth positioning wall 174. A core hole 176 is defined through the inner bottom of the core recess 17 and located along the Z-axis of the core recess 17.

For the arrangement of the first and second parts 11, 12, in one embodiment, a stop wall 177 is located between the deadbolt recess 15 and the core recess 17. The first and second fixing recesses 134, 135, the stop wall 177, the elongate groove 175 and the fourth positioning wall 174 are located in the first part 11. The first and second guiding slots 151, 171 are located in the second part 12. The rest of the components can be installed to the first and second parts 11, 12, but not limited thereto.

The present invention may use different components to be installed to the lock so as to obtain different functions. In the first embodiment, the case 1 has more functions and can be used to the gate door.

Function 1: The Latch Bolt 2 Locking the Lock.

The latch bolt recess 13 includes a latch bolt 2 which includes a head 21, a passive member 22 and a spring 23. The passive member 22 is fixed to the head 21, and the spring 23 is biased between the inside of the latch bolt recess 13 and the passive member 22. When in a closed position, the spring 23 extends to protrude the head 21 out from the case 1. When in an opened position, the spring 23 is compressed so that the head 21 does not protrude out from the case 1. The installation recess 16 includes a top rotation member 24 and a bottom rotation member 25. The top rotation member 24 and the bottom rotation member 25 are overlapped with each other and do not drive each other. The top rotation member 24 includes a first transmission member 241, a first hole 242 located corresponding to the installation hole 162 and a first contact portion 243. The bottom rotation member 25 includes a second transmission member 251, a second hole 252 which is located corresponding to the installation hole 162, and a second contact portion 253. The first positioning portion 161 includes a first resilient member 26 which biases the first contact portion 243. In one embodiment, the first resilient member 26 is a torsion spring, and the torsion spring includes two legs which respectively contact a wall of the installation recess 16 and first and second contact portions 243, 253. The torsion spring provides pivotal force.

In order to control the rotation of the top and bottom rotation members 24, 25, a handle 27 is installed to a first hole 242 and a second hole 252, so that the top and bottom rotation members 24, 25 do not drive mutually. The two respective handles 27 are installed individually and do not drive mutually.

Regarding to the transmission and positioning of the latch bolt 2 and the passive member 22, the latch bolt recess 13 includes a positioning recess 136, a connection recess 137 and the installation recess 16 defined in communication with each other along the X-axis of the latch bolt recess 13. A fifth positioning wall 138 is formed on one end of the X-axis of the latch bolt recess 13. The positioning recess 136 is defined between the fifth positioning wall 138 and the second positioning wall 132. The case 1 includes a connection groove 1381 defined in one end of the fifth positioning wall 138. A first connector 1382 protrudes from the other end of the fifth positioning wall 138. The second positioning wall 132 includes a second connector 1321 which is located corresponding to the first connector 1382. The connection recess 137 is defined between the first connector 1382 and the second connector 1321. The passive member 22 is engaged with the connection groove 1381 and includes a bent portion 221 extending from each of two ends thereof. Each bent portion 221 includes a through hole 222. The latch bolt 2 includes a shank 223 which extends through the through holes 222 and is connected to the head 21. The shank 223 includes a positioning ring 224 mounted thereto which is located between the bent portions 221. The spring 23 is located between the positioning ring 224 and the bent 221 of the head 21 so that the positioning ring 224 is located in the positioning recess 136 and biased by the spring 23 and contacts the first and second connectors 1382, 1321.

Figure 4:
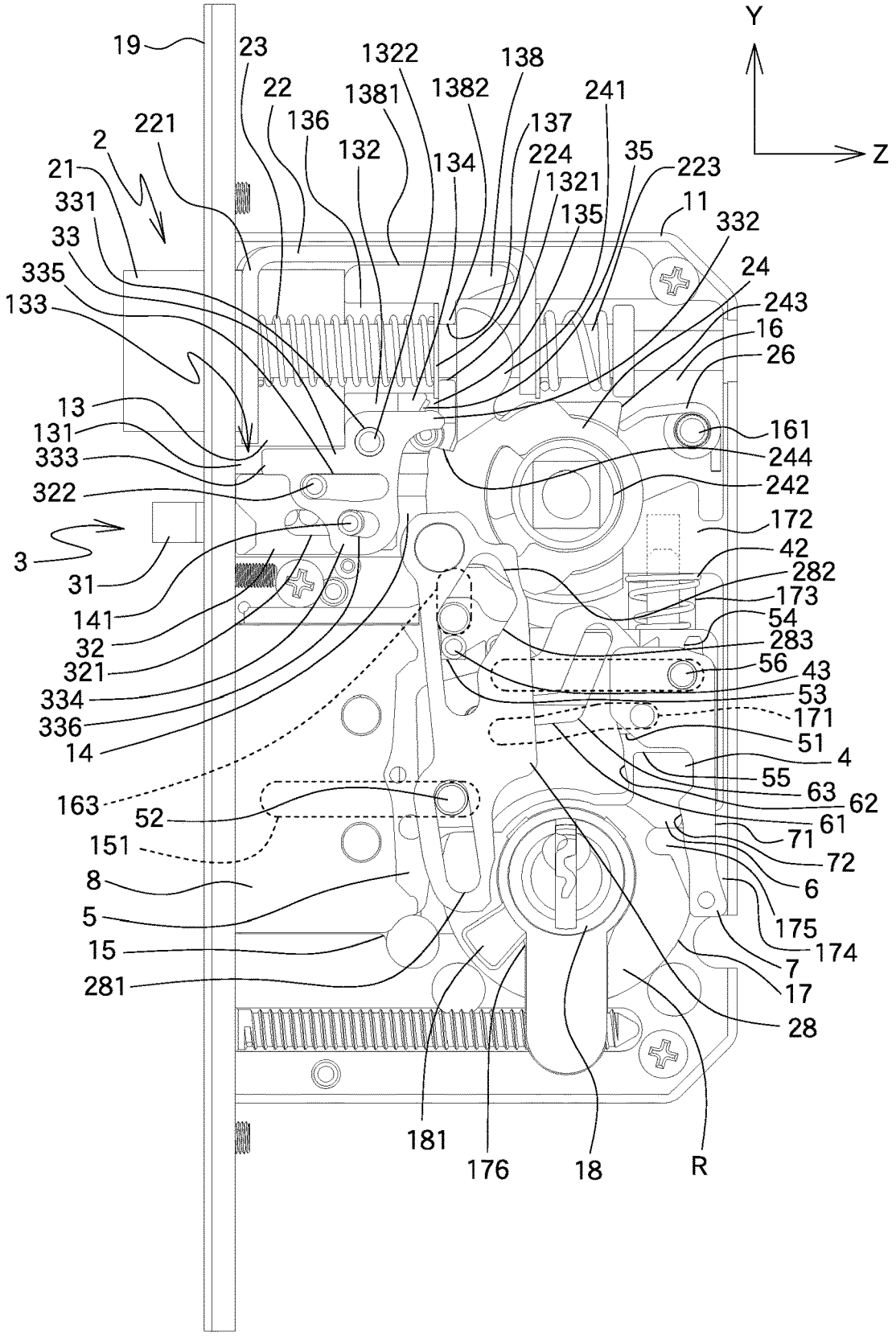
FIG. 4 is a right side view, the second part of the case being removed, showing the first and second guiding slots and the longitudinal slot.
Figure 6:
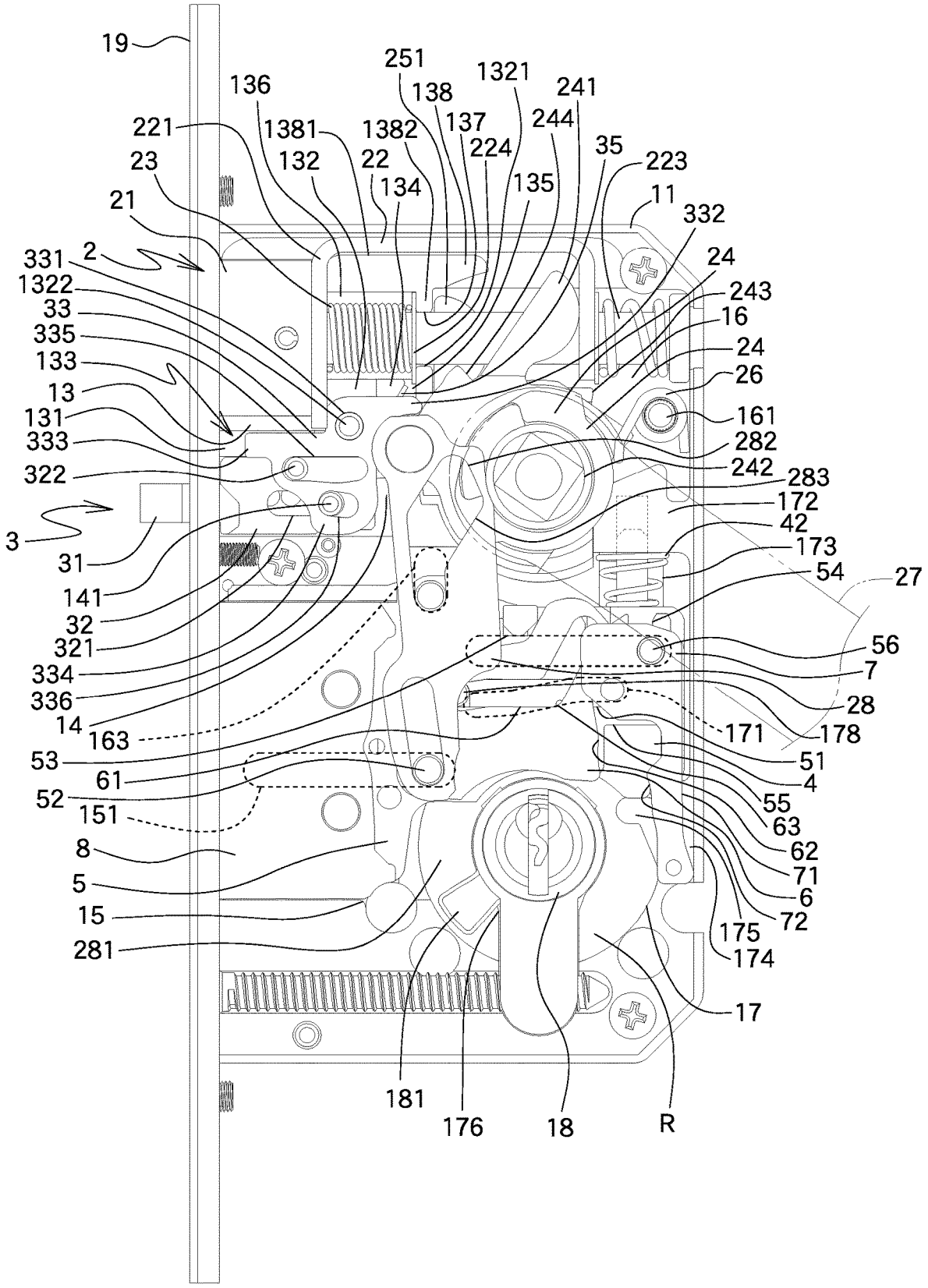
FIG. 6 shows that the handle of the top rotation member of the disclosure in FIG. 4 is rotated and in an opened position.
Figure 7:
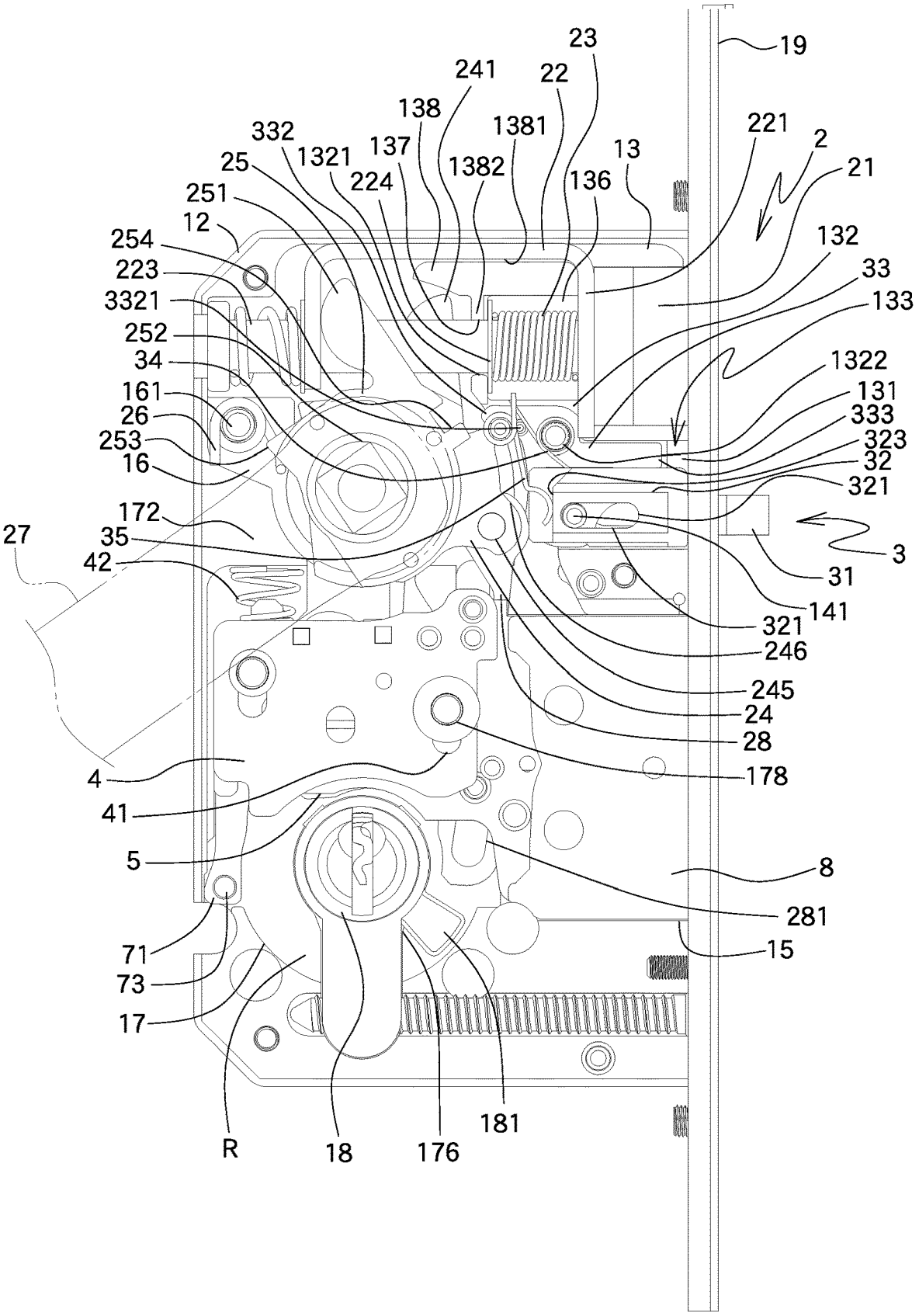
FIG. 7 shows that the handle of the bottom rotation member of the disclosure in FIG. 5 is rotated and in an opened position.

The first transmission member 241 is installed as disclosed in FIG. 6 which is a view from inside of the door, when the users rotate the handle 27 and rotates the top rotation member 24, the first transmission member 241 compresses the first resilient member 26 and contacts the passive member 22, so that the spring 23 is compressed and the head 21 does not protrudes out from the case 1. As shown in FIG. 7 which is a view from outside of the door, the second transmission member 251 is installed as disclosed in FIG. 7. When the users rotate the other handle 27 and rotates the bottom rotation member 25, the second transmission member 251 compresses the first resilient member 26 and contacts the passive member 22, so that the spring 23 is compressed and the head 21 does not protrudes out from the case 1. As the head 21 does not protrudes out from the case 1, the lock is in the opened position and the door can be opened. When in the closed position as shown in FIG. 4, the first resilient member 26 bounces back and contacts the first contact portion 243 and the second contact portion 253. The first transmission member 241 and the second transmission plate 251 do not contact the passive member 22. The head 21 of the latch bolt 2 protrudes out from the case 1 and is inserted into the door frame. The door cannot be opened by rotating the handles 27 form inside or from outside.

Function 2: Preventing the Latch Bolt 2 from being Shifted to Open the Door.

In order to prevent the latch bolt 2 from being shifted to the opened position to open the door by rotating the handle 27 from outside, or to prevent the latch bolt 2 from being directly shifted to the opened position to open the door from outside, the case 1 has a first restriction member 141 in the restriction recess 14. The restriction recess 14 can be installed to the first part 11 but not limited thereto. The restriction recess 14 includes a restriction bolt 3 which has a restriction member 31 and a slide 32. The slide 32 includes a first shifting recess 321 located corresponding to the first restriction member 141. A transmission block 322 is located on the Z-axis of the slide 32. The slide 32 includes a stop face 323 formed on an end face thereof which is located corresponding to the transmission block 322. The second positioning wall 132 includes a second restriction member 1322 which is pivotably connected to a stop plate 33 which has a pivotal portion 331, a transmission portion 332, a stop portion 333 and a guiding portion 334. The pivotal portion 331 is located between the transmission portion 332 and the stop portion 333, and is pivotably connected to the second restriction member 1322. The transmission portion 332 is located corresponding to the second positioning wall 132, and has a contact portion 3321 protruding toward the first fixing recess 134. The top rotation member 24 includes a push block 244 that is able to be rotated from the closed position to the opened position to push the transmission portion 332. And the push block 244 pushes the stop plate 33 to pivot from a stop position to a non-stop position. The stop portion 333 is located corresponding to the first slot 133 and the fifth positioning wall 138. The guiding portion 334 is located corresponding to the slide 32. The guiding portion 334 includes an inclined second shifting recess 335 and an inclined third shifting recess 336. The transmission block 322 is engaged with the second shifting recess 335, and the first restriction member 141 is engaged with the third shifting recess 336. The first fixing recess 134 includes a second resilient member 34 whose one end contacts the contact portion 3321. The second fixing recess 135 includes a third resilient member 35 whose one end contacts the stop face 323. In one embodiment, the second and third resilient members 34, 35 are both torsion springs to provide pivotal forces.

Figure 5:
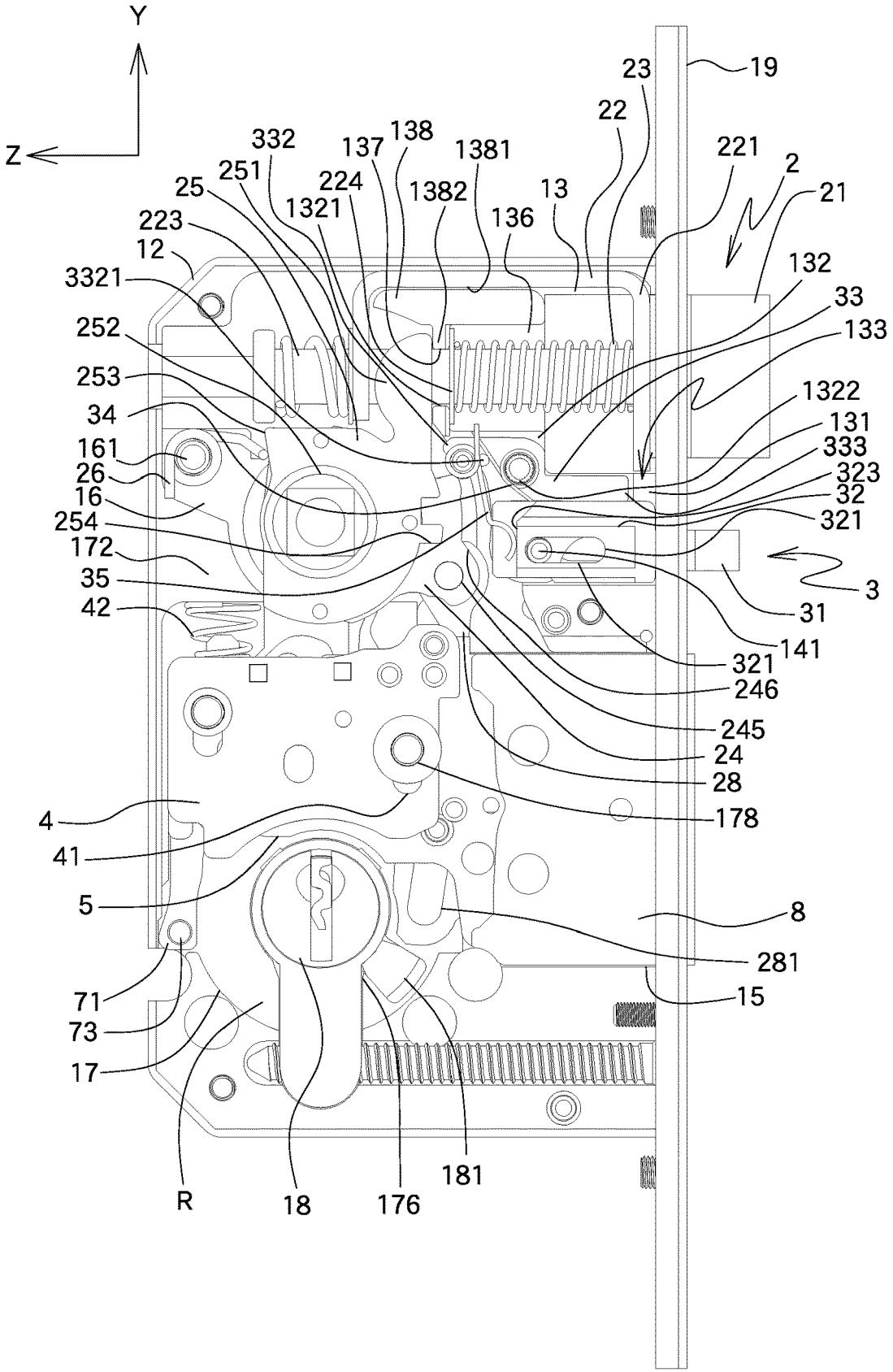
FIG. 5 is a left side view with the first part of the case being removed.
Figure 8:
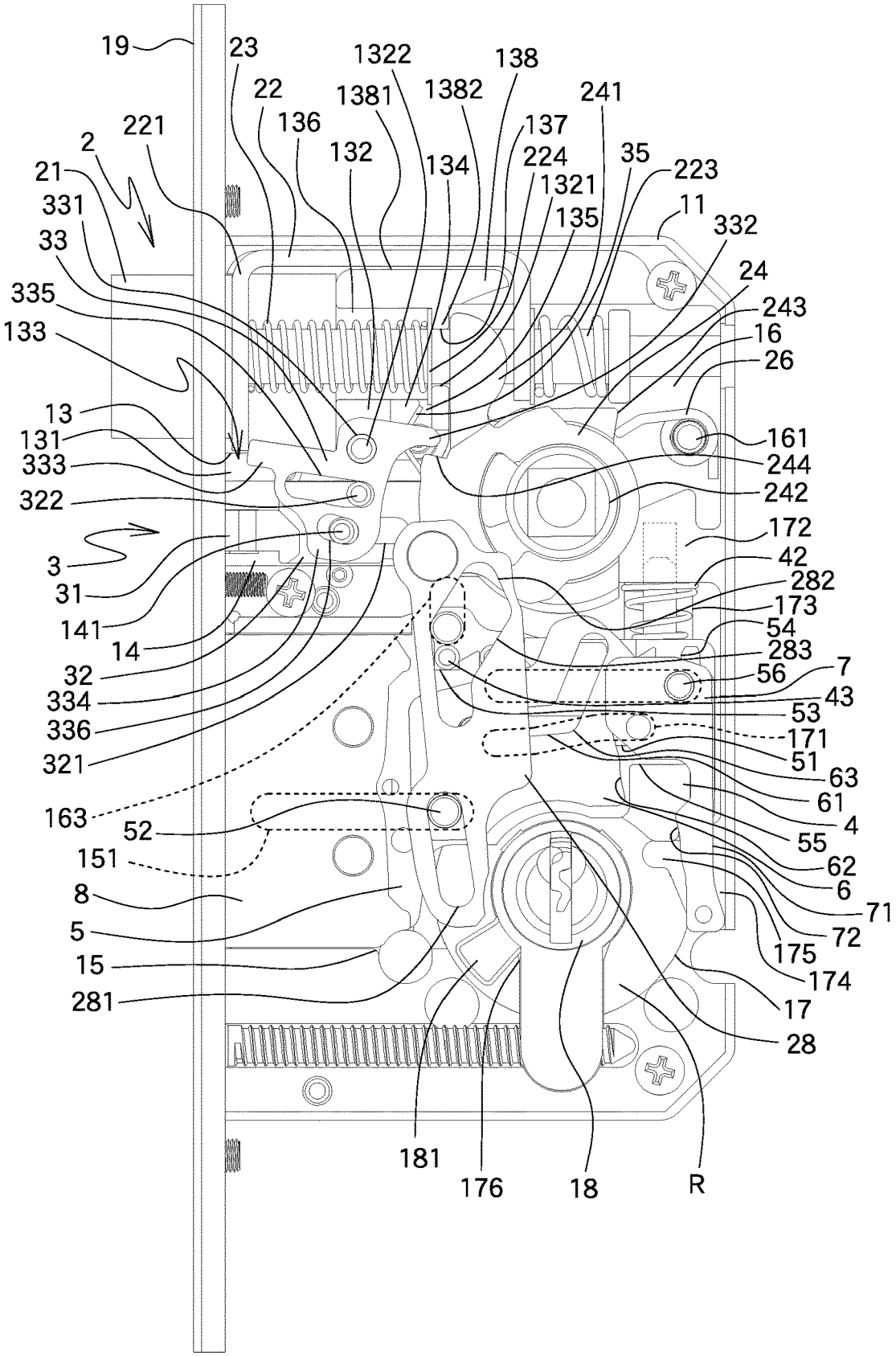
FIG. 8 shows the stop position of the disclosure in FIG. 4.

When in the non-stop position as shown in FIGS. 4 and 5, the third resilient member 35 pushes the restriction member 31 to protrude out from the case 1 via the stop face 323, and makes the transmission block 322 and the first restriction member 141 respectively contact the second and third shifting recesses 335, 336 to let the stop portion 333 not to protrude from the latch bolt recess 13. Alternatively, as shown in FIG. 6, the third resilient member 35 is compressed to make the restriction member 31 not to protrude out from the case 1, and makes the transmission block 322 and the first restriction member 141 are not being pushed. The transmission portion 332 is pushed by the push block 244 of the top rotation member 24 to make the stop portion 333 not to protrude from the latch bolt recess 13. When in the stop position as shown in FIG. 8, the third resilient member 35 is compressed and the restriction member 31 does not protrude out from the case 1. That is to say, the door frame does not have a hole for the restriction bolt 3, and the door frame has a hole that is located corresponding to the latch bolt 2, so that when the door is closed to the door frame, the latch bolt 2 is located at the closed position, and the restriction member 31 does not protrude out from the case 1. The transmission block 322 and the first restriction member 141 are not pushed, and the stop plate 33 is pushed by the recovery force from the second resilient member 34 to pivot the stop plate 33 by the contact portion 3321, so that the stop portion 333 protrudes into the latch bolt recess 13 when in the closed position. The latch bolt 2 cannot be retracted into the latch bolt recess 13 by neither a force applied from outside of the case 1, not by rotating the handle 27 to rotate the bottom rotation member 25 from outside of the door. The only way is to rotate the handle 27 from the inside of the door to let the push block 244 of the top rotation member 24 push the transmission portion 332 to remove the stop portion 333 from the latch bolt recess 13 to shift the latch bolt 2 from the closed position to the opened position.

Function 3: The Locking Feature of the Deadbolt 8.

In order to enhance the locking feature of the deadbolt 8, the core recess 17 includes a first guide member 178, a restriction plate 4, an engaging member 5, an extension plate 6 and a stop plate 7. The core recess 17 includes a core 18 via the core hole 176, the core 18 includes a cam 181 which is rotatable. The range of the rotation of the cam 181 defines a loop-like rail "R". The core 18 includes a keyhole in each of two ends thereof. A knob may be connected to the core 18 at the inside of the door to directly rotate the cam 181, and the core 18 has a keyhole at the outside of the door for accepting a key inserted therein.

The bottom of the restriction plate 4 is located at the rail "R". The first guide member 178 extends through a first guide hole 41 defined in the restriction plate 4 so as to balance and restrict the moveable range of the restriction plate 4. A resilient unit 42 is biased between the restriction plate 4 and the bottom of the third positioning wall 172. The resilient unit 42 is connected to the second positioning portion 173 and the resilient direction of the resilient unit 42 is correspondent to the first guide hole 41. The restriction plate 4 includes at least one engaging member 43.

One end of the driving member 5 is connected to the deadbolt 8 which is movable in the deadbolt recess 15 and is stopped by the stop wall 177. The driving member 5 includes a slide slot 51 in which the first guide member 178 extends. The driving member 5 includes a second guide member 52 which is slidable in the first guiding slot 151 and located corresponding to one end face of the restriction plate 4. The driving member 5 includes a first notch 53 and a second notch 54 defined in the top thereof, and the first and second notches 53, 54 are located corresponding to the engaging member 43. The driving member 5 includes a third notch 55 which is located corresponding to the bottom of the deadbolt 8. The driving member 5 includes a third guide member 56 that is located opposite to one end of the deadbolt 8 and one end face of the restriction plate 4, and the third guide member 56 is slidable in the second guiding slot 171 so as to stabilize the transmission direction of the driving member 5.

The extension plate 6 has an end thereof eccentrically and pivotably connected to the second guide member 52, and the extension plate 6 includes an extension slot 61 which extends toward two opposite extension directions which are located corresponding to the slide slot 51. An intermediate point 63 is formed at the turning position where the two opposite extension directions meet. The first guide member 178 slidable within the extension slot 61. The extension plate 6 includes a concaved portion 62 defined in the lateral side corresponding to the second guide member 52.

A stop plate 7 is pivotably connected to the third guide member 56, and the stop plate 7 includes an extension portion 71 which includes a corner 72. The extension portion 71 includes a rod 73 which is slidable in the elongate groove 175 defined in an end face of the case 1.

The top rotation member 24 includes a pivotal member 245 which is pivotably connected to a transmission plate 28. The transmission plate 28 includes a guide slot 281 to which the second guide member 52 is mounted.

Figure 9:
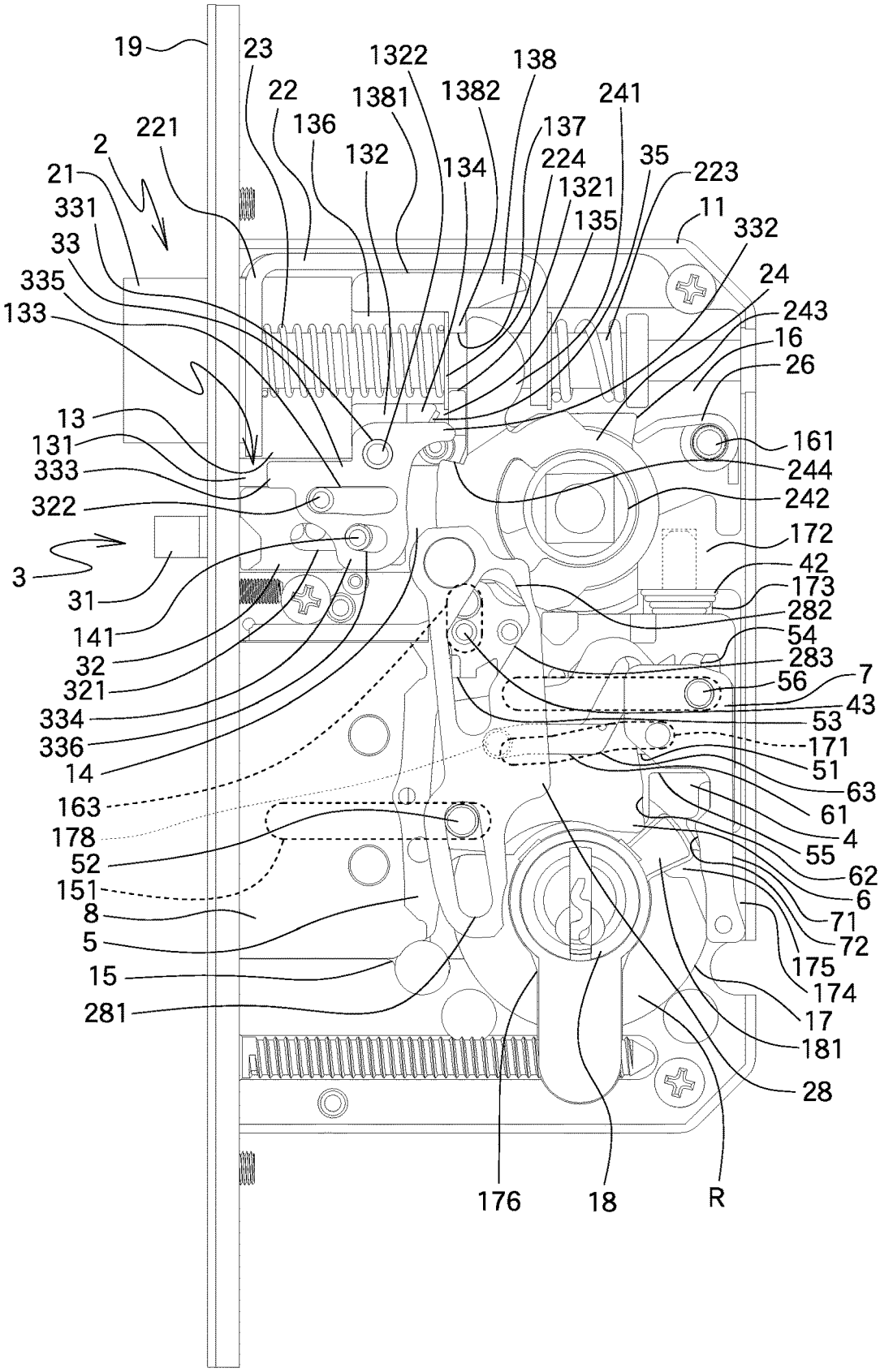
FIG. 9 shows that the cam in FIG. 4 is rotated to lift the restriction plate.
Figure 10:
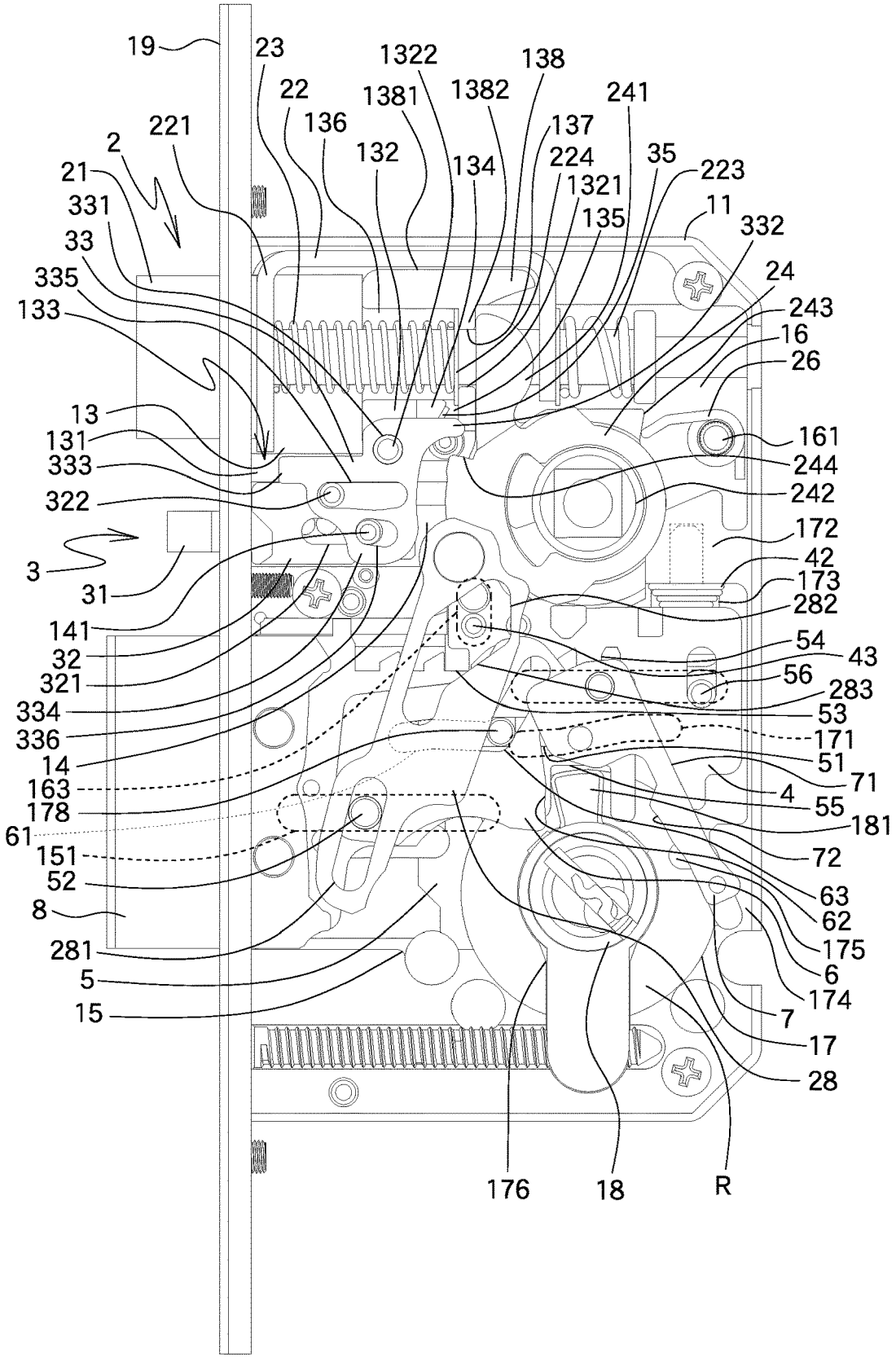
FIG. 10 shows that the lock in FIG. 9 is operated to the middle position.
Figure 11:
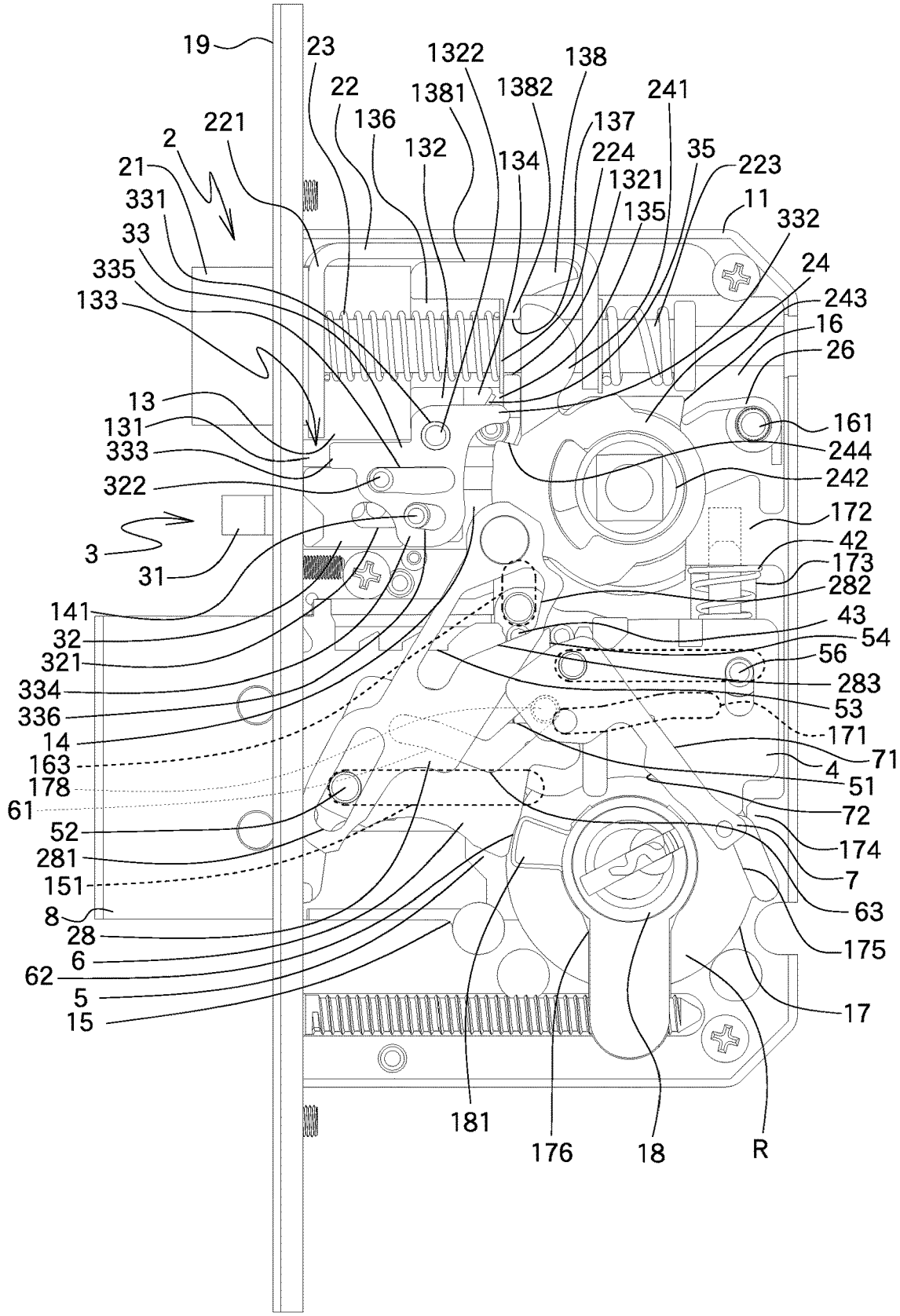
FIG. 11 shows that the lock in FIG. 9 is operated to the locked position.

When in the locked position, as shown in FIGS. 4 and 9, the cam 181 of the core 18 first pushes the restriction plate 4 upward to compress the resilient unit 42, and the cam 181 contacts the left wall of the third notch 55 of the driving member 5 so that the driving member 5 gradually moves toward left. In the meanwhile, the stop plate 7 is pulled toward the left by the third guide member 56, and the rod 73 is engaged with the elongate slot 175, so that the stop plate 7 is pivoted. The first guide member 178 is located in one of the extension direction of the extension slot 61. As shown in FIG. 10, the first guide member 178 is located at the middle position. Because the extension slot 61 includes two extension directions so that there will be a mediate point 63 at the position where the two extension directions meet. When at the middle position, the deadbolt 8 partially protrudes into the deadbolt recess 15 as mentioned before, and the first guide member 178 is located at the mediate position 63, and the extension plate 6 is located at the rail "R". When the cam 181 continuously rotates counter clockwise, the cam 181 pivots the extension plate 6 and drives the driving member 5 toward the left. The first guide member 178 moves toward the other direction of the extension slot 61 so that the driving member 5 moves a long distance by one single rotation of the cam 181, and the deadbolt 8 protrudes a long distance as well. The concaved portion 62 is formed to allow the extension plate 6 to be pivoted by the cam 181. In one embodiment, the concaved portion 62 can be omitted and the function can also be proceeded by a specific shape of the extension plate 6. As shown in FIG. 11, after the extension plate 6 is pivoted, the lock is at its locked position, the deadbolt 8 protrudes into the deadbolt recess 15. The cam 181 is disengaged from the restriction plate 4 and the restriction plate 4 is moved to its initial position by recovery force. The engaging member 43 is engaged with the second notch 54 to prevent the deadbolt 8 from being retracted into the deadbolt recess 15 by a force from outside of the case 1. The first guide member 178 is located at one inner end of the extension slot 61 and the slide slot 51 and opposite to the deadbolt 8. The transmission plate 28 is not rotatable by the restriction of the second guide member 52. When rotating the top rotation member 24, because the transmission plate 28 is stopped by the second guide member 52, the top rotation member 24 is located at the closed position, and the rod 73 is moved to the top inner end of the elongate groove 175.

Figure 12:
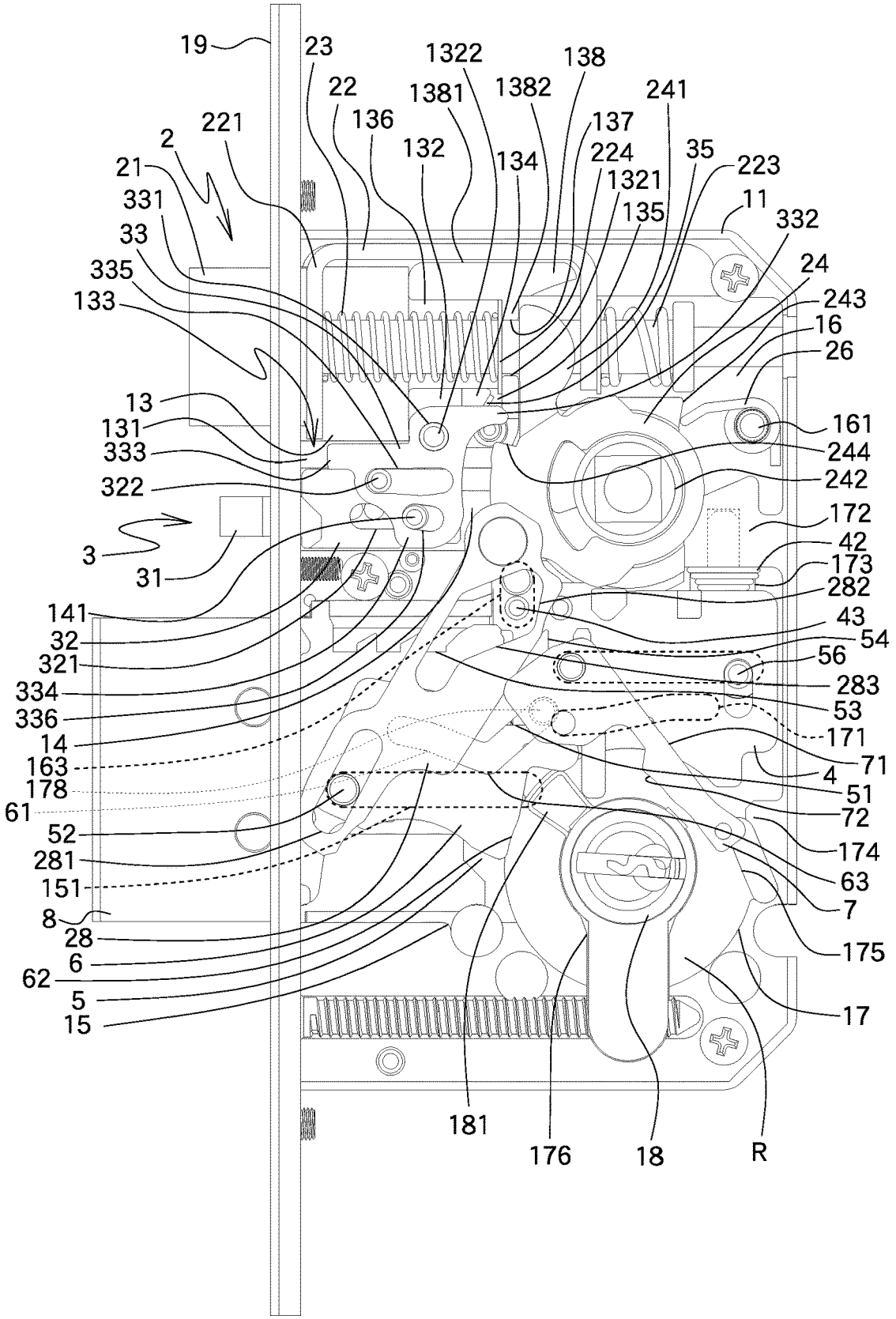
FIG. 12 shows that the cam in FIG. 11 is rotated to lift the restriction plate.
Figure 13:
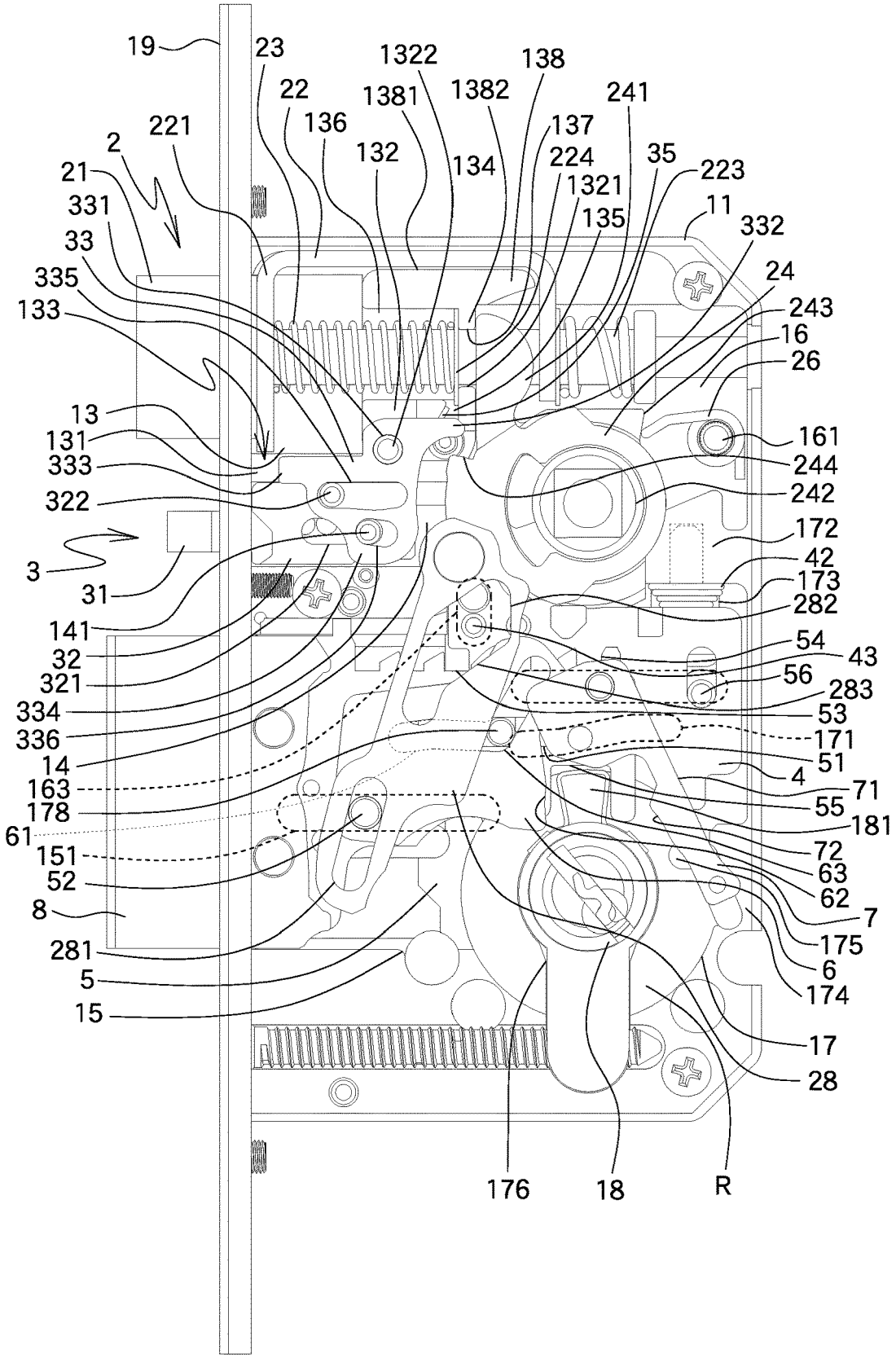
FIG. 13 shows that the lock in FIG. 12 is operated to the middle position.
Figure 14:
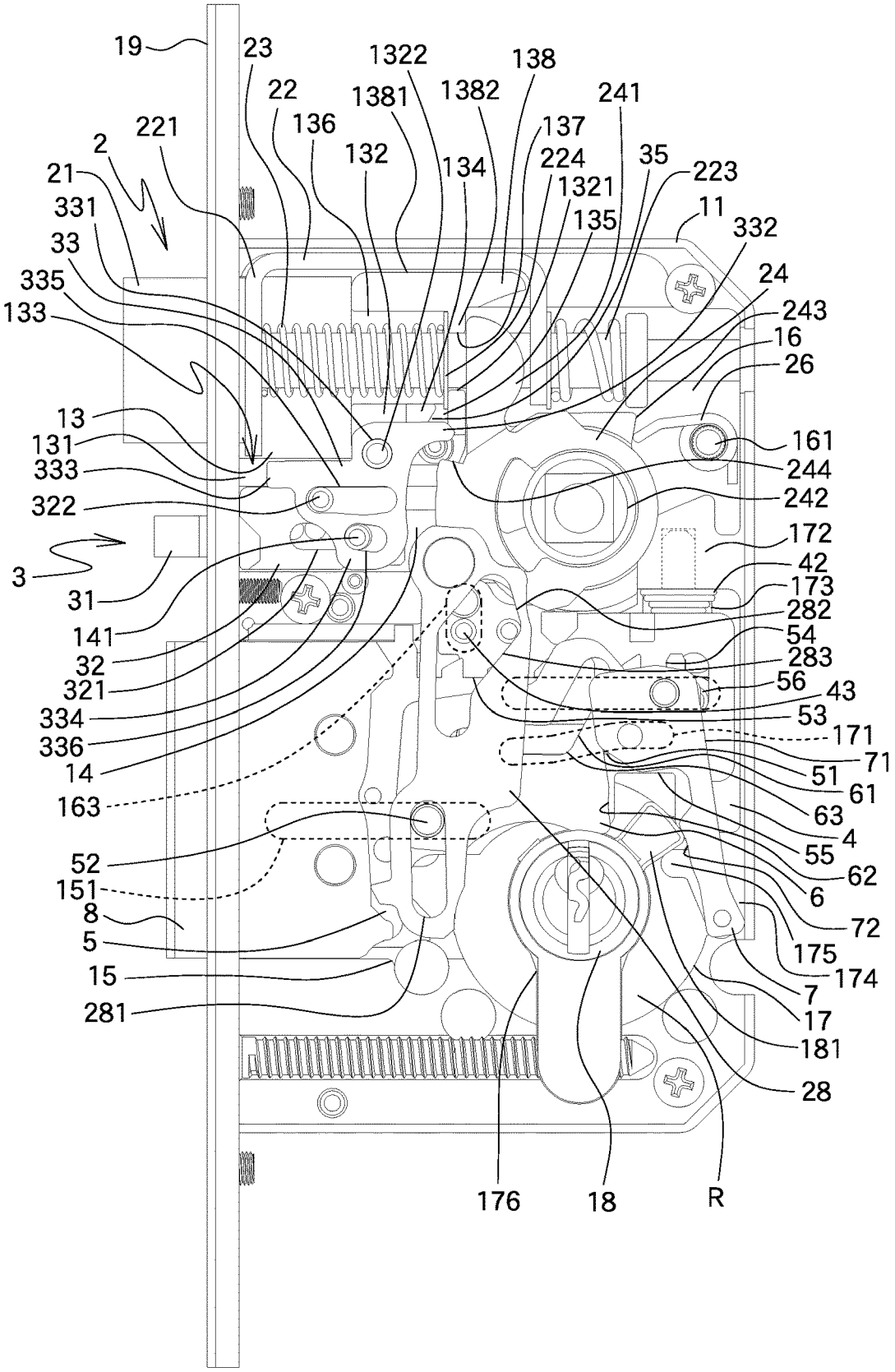
FIG. 14 shows that the lock in FIG. 13 is transmitted to the cam to push the corner of stop plate.
Figure 15:
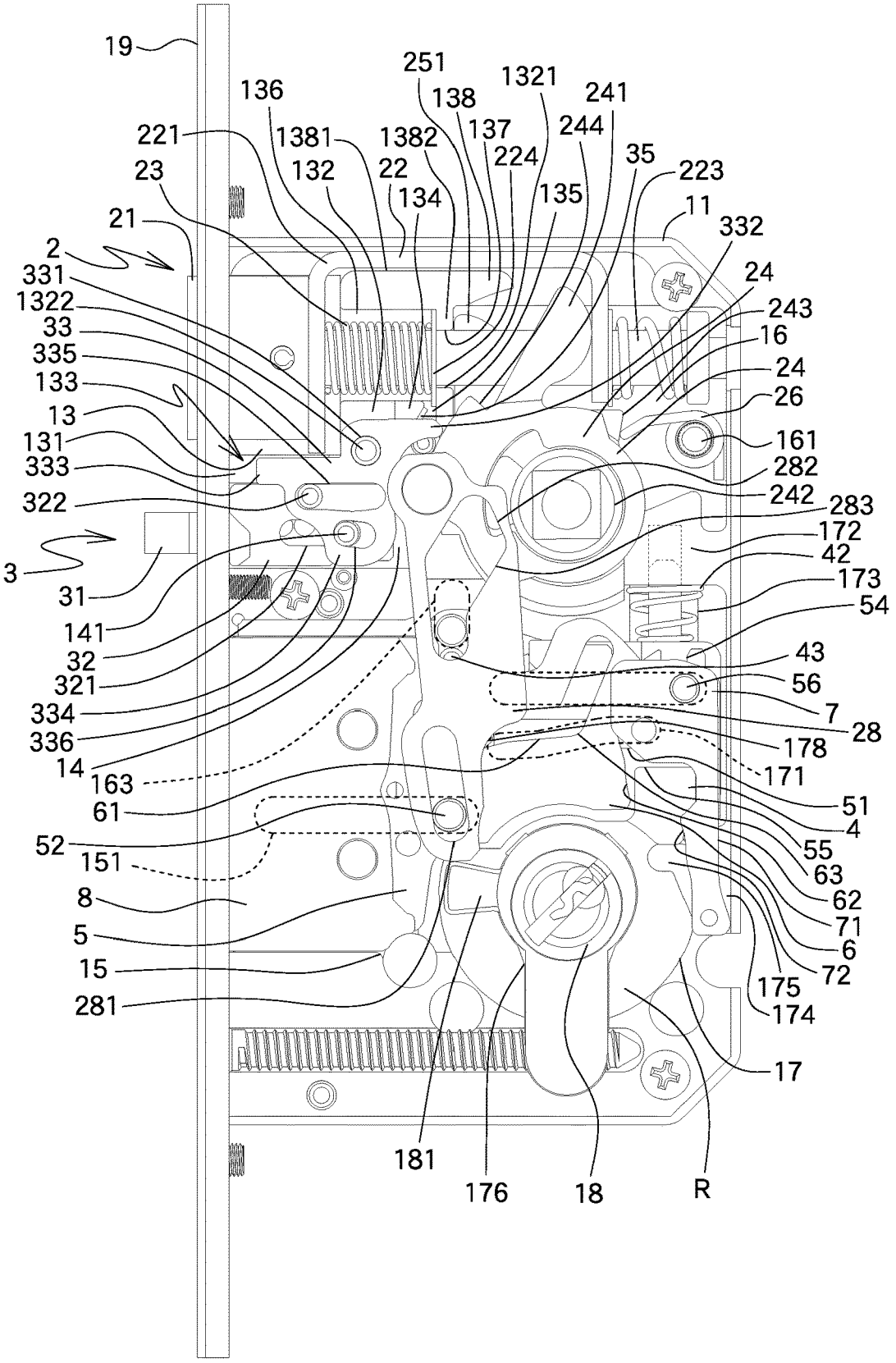
FIG. 15 shows that the lock in FIG. 4 is transmitted to the cam to push the transmission plate to the opened position.

During the process to the unlocked position, as shown in FIGS. 12, 13 and 9 in sequence, the cam 181 rotates clockwise to lift the restriction plate 4 to disengage the engaging member 43 from the second notch 54. The can 181 contacts the right wall of the third notch 55 so that the driving member 5 gradually moves to the left. As shown in FIG. 14, in order to allow the deadbolt 8 to be completely inserted into the deadbolt recess 15, by the corner 72 of the stop plate 7, the cam 181 contacts the corner 72 when returning to the unlocked position, so that the stop plate 7 drives the driving member 5 to let the deadbolt 8 return to the unlocked position as shown in FIG. 4. The corner 72 is then removed from the rail "R", and the engaging member 43 is engaged with the first notch 53 because the cam 181 is removed from the restriction plate 4. The first guide member 178 is located at the other inner end of the extension slot 61 and the slide slot 51. The second guide member 52 is located at the top inner end of the guide slot 281. By the function 1 mentioned before, the latch bolt 2 moves to the open position by rotating the top rotation member 24, and the second guide member 52 is located at the bottom inner end of the guide slot 281. As shown in FIG. 15, by the rotation of the cam 181 in the unlocked position, the cam 181 pushes the transmission plate 28 upward so as to operate the top rotation member 24. As mentioned before, the latch bolt 2 and the top rotation member 24 are located at the open position.

In one embodiment, the functions 1, 2, and 3 are combined. The lock includes the latch bolt 2, the deadbolt 8 and the restriction bolt 3. The case 1 includes a strike plate 19 which includes a first hole located corresponding to the latch bolt recess 13, a second hole located corresponding to the restriction recess 14, and a third hole located corresponding to the deadbolt recess 15. The latch bolt 2 can be inserted into the first hole, the restriction bolt 3 can be inserted into the second hole, and the deadbolt 8 can be inserted into the third hole. The first, second and third holes of the strike plate 19 may vary according the installation of the latch bolt 2, the restriction bolt 3 and the deadbolt 8 to the lock.

Function 4: Long Travel Distance of the Deadbolt 8.

It is noted that the functions 1, 2 and 3 are described before, wherein the extension plate 6 is mainly used to allow the deadbolt 8 to extend at least 22 mm by one-time rotation of the core 18 to meet the related regulations and improve the shortcoming of the conventional locks which require multiple rotation of the core. The function 4 includes all of the functions 1, 2 and 3. In one embodiment, the case 1 may not be used, other type of case may also be used.

In one embodiment, the following structure and components are required to obtain the function. The present invention provide another embodiment of the lock wherein the deadbolt has a long travel distance by one-time operation.

The lock comprises a case 1 having a core recess 17 and a deadbolt recess 15. A elongate groove 175 is defined in one end face of the case 1. The core recess 17 including a first guide member 178 and defines a loop-shaped rail "R".

A driving member 5 has an end fixed to a deadbolt 8 which is movably in the deadbolt recess 15. The driving member 5 has a slide slot 51 in which the first guide member 178 is slidably received therein. The driving member 5 has a second guide member 52 on an end face thereof. A third notch 55 is defined in the bottom of the driving member 5. For the deadbolt 8, the case 1 includes a stop wall 177 located between the core recess 17 and the deadbolt recess 15, the deadbolt 8 is movable in the deadbolt recess 15 and stopped by the stop wall 177. The third notch 55 is located at the rail "R".

An extension plate 6 has an end thereof eccentrically and pivotably connected to the second guide member 52. The extension plate 6 includes an extension slot 61 which extends toward two opposite extension directions which are located corresponding to the slide slot 51. An intermediate point 63 is formed at a turning position where the two opposite extension directions meet. The first guide member 178 is slidable within the extension slot 61. In order to let the cam 181 pushes the extension plate 6 at the middle position, the extension plate 6 includes a concaved portion 62 defined in the lateral side corresponding to the second guide member 52. The concaved portion 62 and a sidewall of the concaved portion 62 are located at the rail "R" when at the middle position.

In order to help the deadbolt 8 to be moved to the unlocked position, in one embodiment, the driving member 5 includes a third guide member 56 on one end face. A stop plate 7 is pivotably connected to the third guide member 56, and the stop plate 7 includes an extension portion 71 which includes a corner 72. The extension portion 71 includes a rod 73 which is slidable in an elongate groove 175 defined in an end face of the case 1.

The lock includes the function 3 that the core 18 drives the deadbolt 8. As shown in FIGS. 4 and 9-14, when in the unlocked position, the deadbolt 8 is located in the deadbolt recess 15, and the first guide member 178 is located in the extension slot 61 and one end of the slide slot 51. The rod 73 is located at the bottom inner end of the elongate groove 175. The corner 72 is removed from the rail "R" when at the unlocked position. When at the middle position, the deadbolt 8 partially protrudes into the deadbolt recess 15, and the first guide member 178 is located at the mediate point 63. The extension plate 6 is located at the rail "R" and can be pushed by the cam 181 to increase the travel distance of the deadbolt 8. When at the locked position, the deadbolt 8 partially protrudes into the deadbolt recess 15, and the extension plate 6 is pivoted by the first guide member 178 so that the first guide member 178 is located in the extension slot 61 and the other end of the slide slot 51 that is located opposite to the deadbolt 8. The rod 73 is located at the inner top end of the elongate slot 175.

In order to prevent the deadbolt 8 from being retracted into the deadbolt recess 15 by a force from outside of the case 1, the restriction plate 4 as mentioned before can be installed. The operation and function will not be repeated here.

If the lock with the long travel distance of the deadbolt can be unlocked from operation of the handle 27 located the inside of the case 1, the case 1 includes a latch bolt recess 13 and an installation recess 16. The case 1 includes an installation hole 162 defined in the Z-axis thereof and located within the inner bottom of the installation recess 16. The latch bolt recess 13 includes a latch bolt 2 which includes a head 21, a passive member 22 and a spring 23. The passive member 22 is fixed to the head 21. The spring 23 is biased between the inside of the latch bolt recess 13 and the passive member 22. When in a closed position, the spring 23 extends to protrude the head 21 out from the case 1. When in an opened position, the spring 23 is compressed so that the head 21 does not protrude out from the case 1. The installation recess 16 includes a top rotation member 24 which includes a first transmission member 241, a first hole 242 located corresponding to the installation hole 162, and a first contact portion 243. The installation recess 16 includes a first positioning portion 161 located corresponding to the distal end of the latch bolt recess 13. The first positioning portion 161 includes a first resilient member 26 which biases the first contact portion 243. When the first transmission member 241 is assigned to the top rotation member 24 and is rotated by the top rotation member 24, the first contact portion 243 compresses the first resilient member 26 and pushes the passive member 22 so that the spring 23 is compressed and the head 21 does not protrude out from the case 1.

In another embodiment, if the lock can be unlocked by operation of the handle 27 at the outside of the case 1, the installation recess 16 includes a bottom rotation member 25. The top rotation member 24 and the bottom rotation member 25 are overlapped with each other and do not drive mutually. The bottom rotation member 25 includes a second transmission member 251, a second hole 252 which is located corresponding to the installation hole 162, and a second contact portion 253. Preferably, the first resilient member 26 is a torsion spring. The torsion spring includes two legs which respectively contact the wall of the installation recess 16 and first and second contact portions 243, 253. When the first transmission member 241 and the second transmission member 251 are assigned to the top rotation member 24 or the bottom rotation member 25, and are rotated, the first contact portion 243 or the second contact portion 253 compresses the first resilient member 26 and pushes the passive member 22 so that the spring 23 is compressed and the head 21 does not protrude out from the case 1.

In yet another embodiment, for the latch bolt 2, the latch bolt recess 13 includes a positioning recess 136, a connection recess 137 and the installation recess 16 defined in communication with each other along the X-axis of the latch bolt recess 13. A fifth positioning wall 138 is formed on one end of the X-axis of the latch bolt recess 13. The positioning recess 136 is defined between the fifth positioning wall 138 and the second positioning wall 132. The case 1 includes a connection groove 1381 defined in one end of the fifth positioning wall 138. A first connector 1382 protrudes from the other end of the fifth positioning wall 138. The second positioning wall 132 includes a second connector 1321 which is located corresponding to the first connector 1382. The connection recess 137 is defined between the first connector 1382 and the second connector 1321. The passive member 22 is engaged with the connection groove 1381 and includes a bent portion 221 extending from each of two ends thereof. Each bent portion 221 includes a through hole 222. The latch bolt 2 includes a shank 223 which extends through the through holes 222 and is connected to the head 21. The shank 223 includes a positioning ring 224 mounted thereto which is located between the bent portions 221. The spring 23 is located between the positioning ring 224 and the bent 221 of the head 21 so that the positioning ring 224 is located in the positioning recess 136 and biased by the spring 23 and contacts the first and second connectors 1382, 1321.

Function 5: Preventing the Bottom Rotation Member 25 from being Rotated by Operation of the Handle 27 at Outside of the Case 1.

Figure 16:
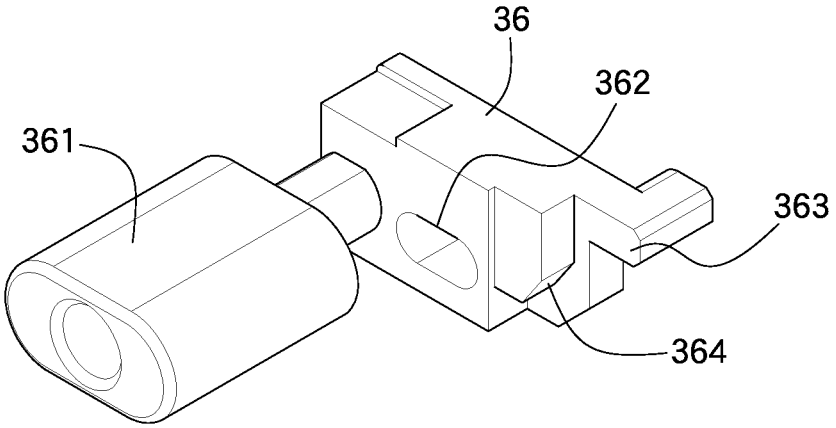
FIG. 16 shows the lock block of the lock of the present invention.
Figure 17:
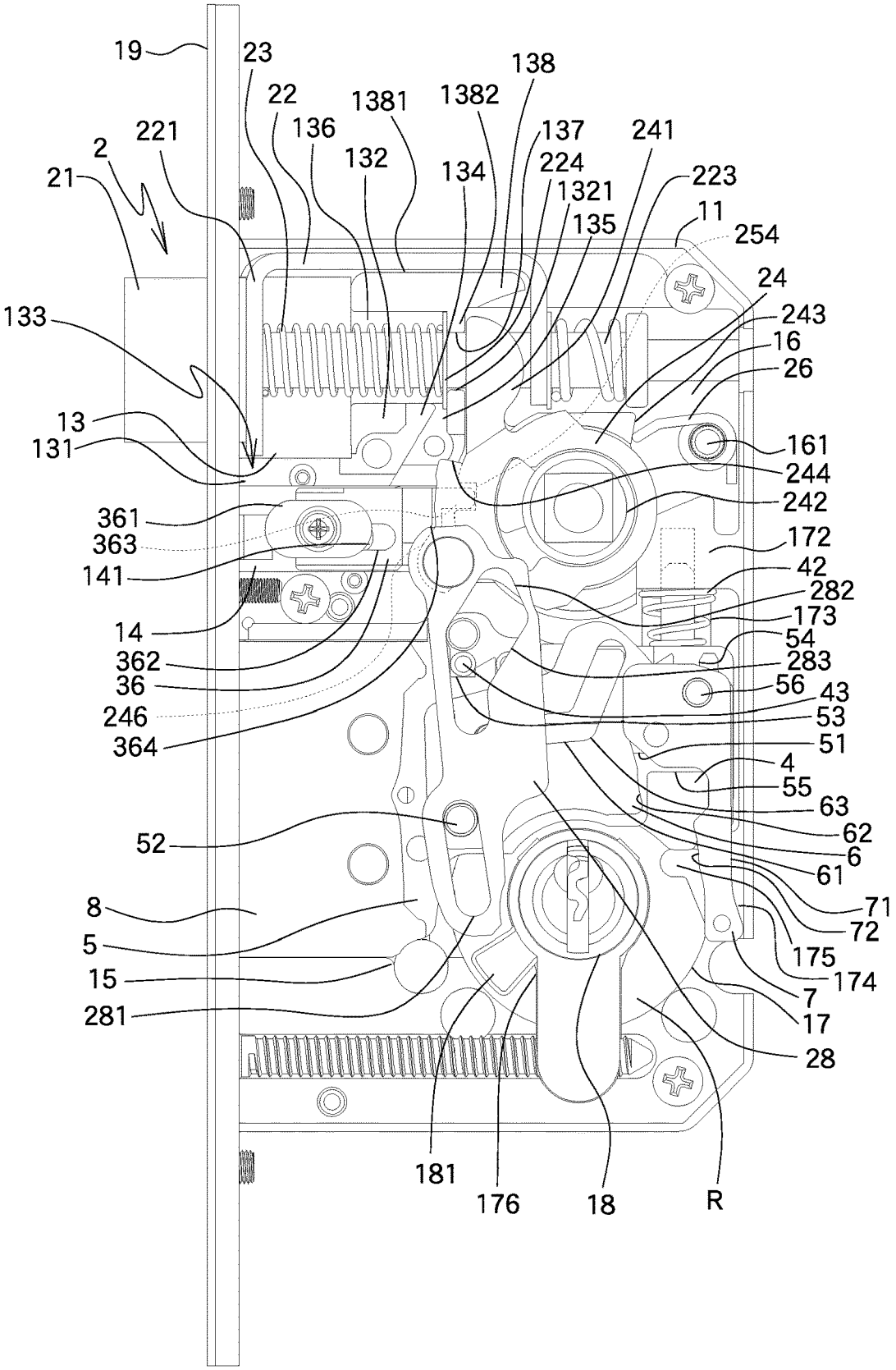
FIG. 17 is a right side view of the second embodiment of the lock which is located at the first position and shows the bore, with the second part of the case being removed.
Figure 18:
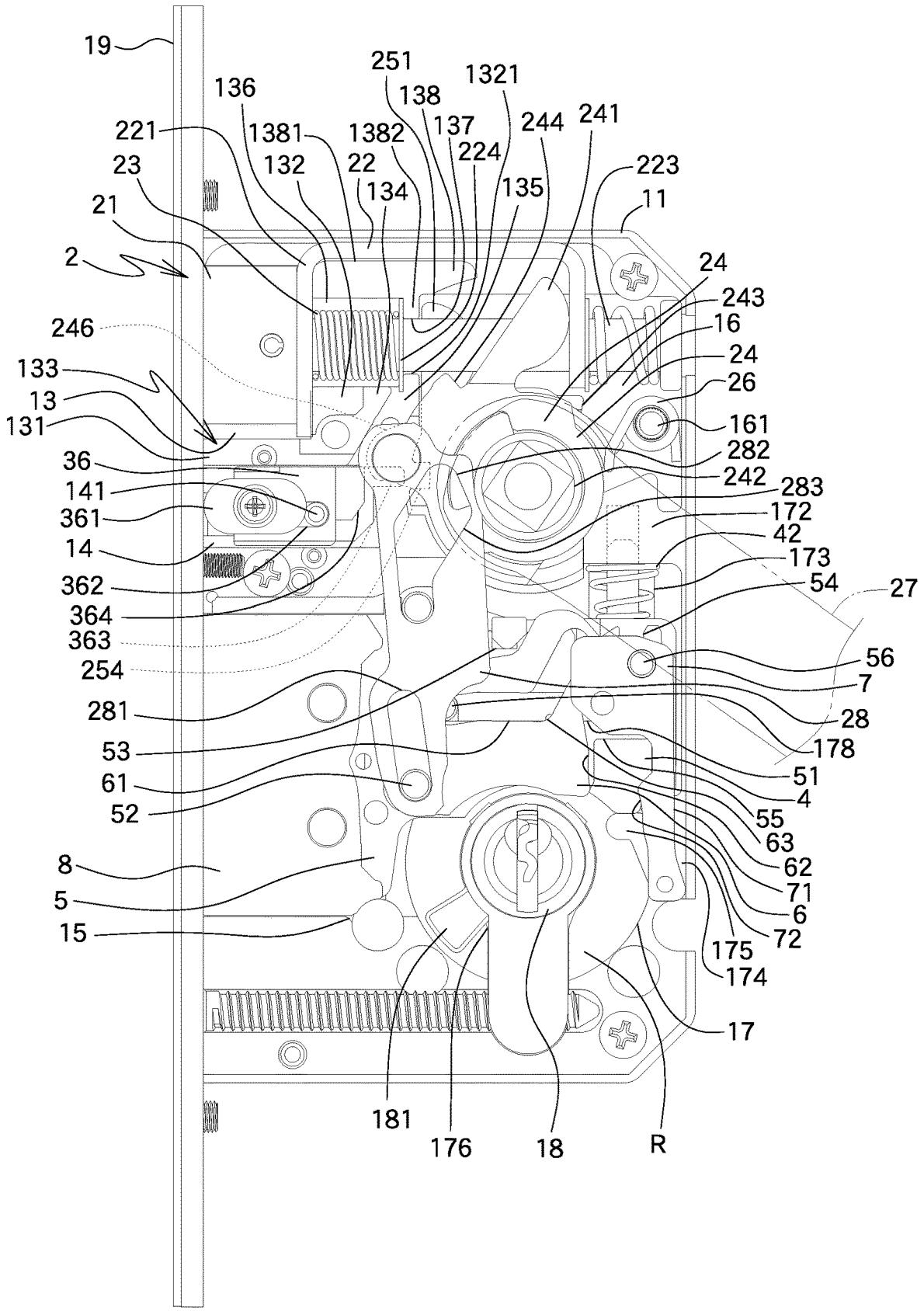
FIG. 18 shows the second position of the disclosure in FIG. 17.

As shown in FIGS. 16 to 18, a second embodiment of the lock is disclosed, and the differences between the first and second embodiments are that the restriction recess 14 includes a lock block 36, and does not have the restriction bolt 3 and the stop plate 33 as mentioned in function 2. Therefore, the function 5 and the function 2 cannot be existed simultaneously, but can be existed with the functions 1, 3 and 4. The second embodiment is used to the door of bathrooms, kitchens and hallways. The core 18 may have a keyhole in each of two ends thereof, alternatively, a knob can be connected to the core located at the inside of the door so as to directly rotate the cam 181. A key is used to be inserted into the keyhole from the outside of the door, depending on practical needs. The case 1 includes a bore 142 which is located corresponding to the restriction recess 14, and the bore 142 is defined in the second part 12 and includes the lock block 36 slidably received therein. The lock block 36 includes a control bar 361, a passage 362, an engaging portion 363 and an inclined portion 364. The control bar 361 protrudes beyond the bore 142. The first restriction member 142 extends through the passage 362. The bottom rotation member 25 includes an engaging notch 254 which is located corresponding to the engaging portion 363. The top rotation member 24 includes a push portion 246 which is located corresponding to the inclined portion 364. As shown in FIG. 17, when in the closed position, the lock block 36 is located at a first position where the lock block 36 slides to engage the engaging portion 363 with the engaging notch 254. Therefore, the operation of the handle 27 on the outside of the door cannot rotate the bottom rotation member 25 to position the latch bolt 2 at the unlocked position. As shown in FIG. 18, the top rotation member 24 is rotated by operating the handle 27 on the inside of the door. Alternatively, the top rotation member 24 can also be rotated by using the core 18 at the inside or outside to rotate the core 181 to rotate the top rotation member 24 by the transmission plate 28. Therefore, the top rotation member 24 is rotated from the closed position to the opened position, the push portion 246 contacts the inclined portion 364 to drive the lock block 36 to a second position such that the engaging portion 363 is disengaged from the engaging notch 254. The lock block 36 releases the bottom rotation member 25, and the latch bolt 2 is located at the opened position.

In this embodiment, because there is no restriction bolt 3, so that the case 1 includes the first hole located corresponding to the latch bolt recess 13, and the strike plate 19 having the third hole located corresponding to the deadbolt recess 15.

Function 6: Unlocking Feature in Emergency.

Figure 19:
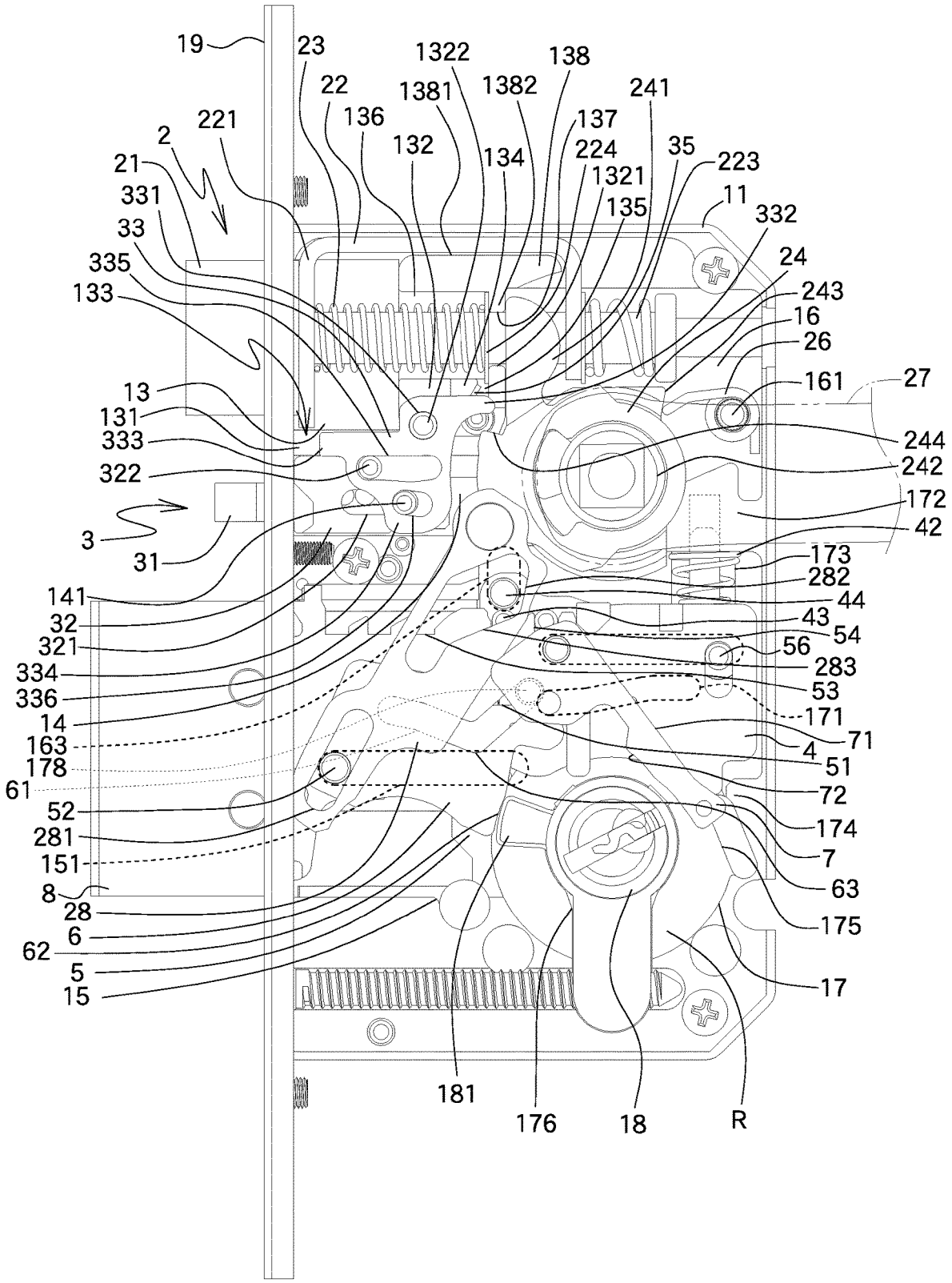
FIG. 19 is a right side view with the second part of the case being removed of the third embodiment of the lock of the present invention, and shows the longitudinal slot, wherein the lock is in the locked position.
Figure 20:
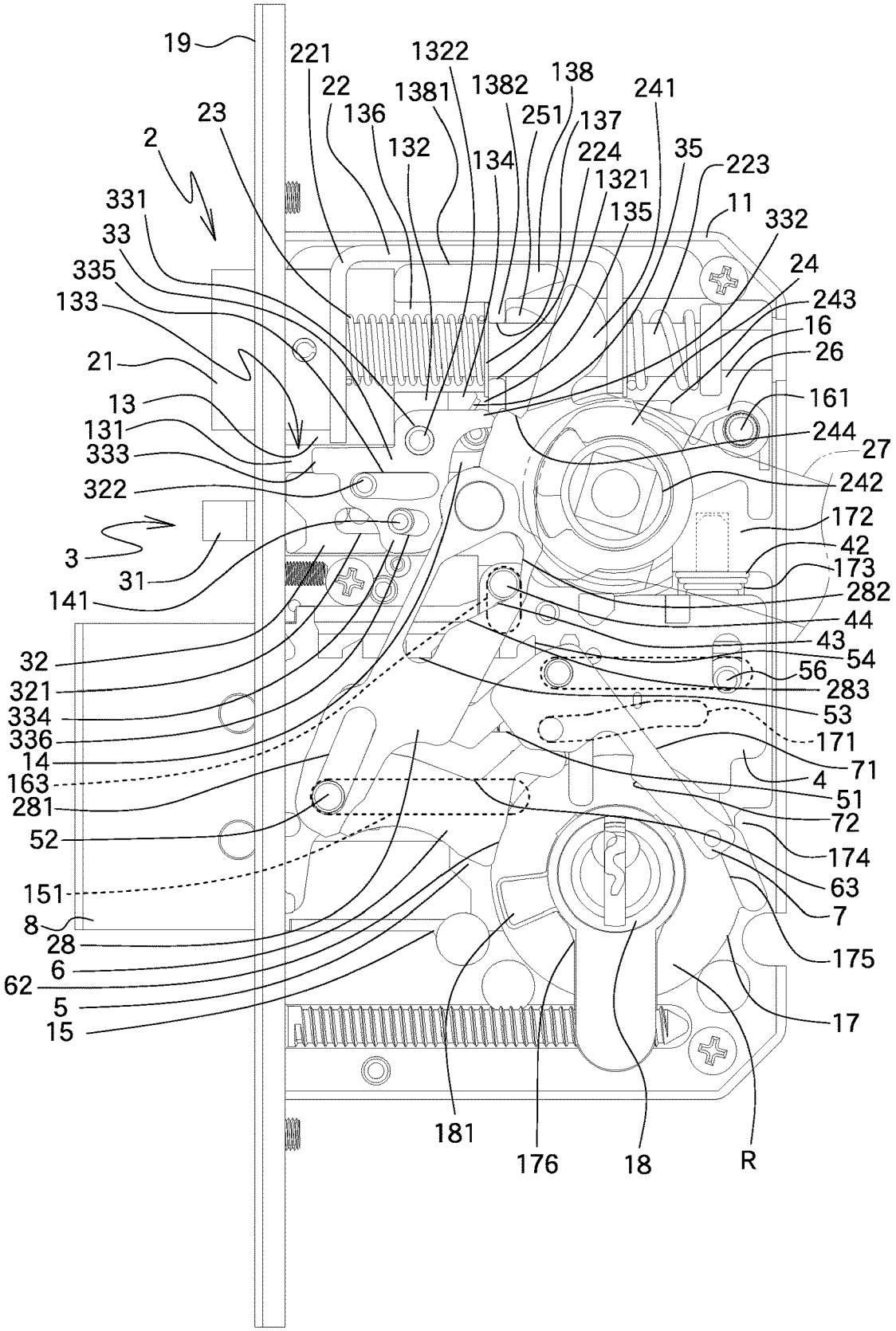
FIG. 20 shows that the transmission plate in FIG. 19 cooperates with the guide face to let the restriction part drive the restriction plate so that the restriction plate moves to the position where the engaging member is removed from the second notch.
Figure 21:
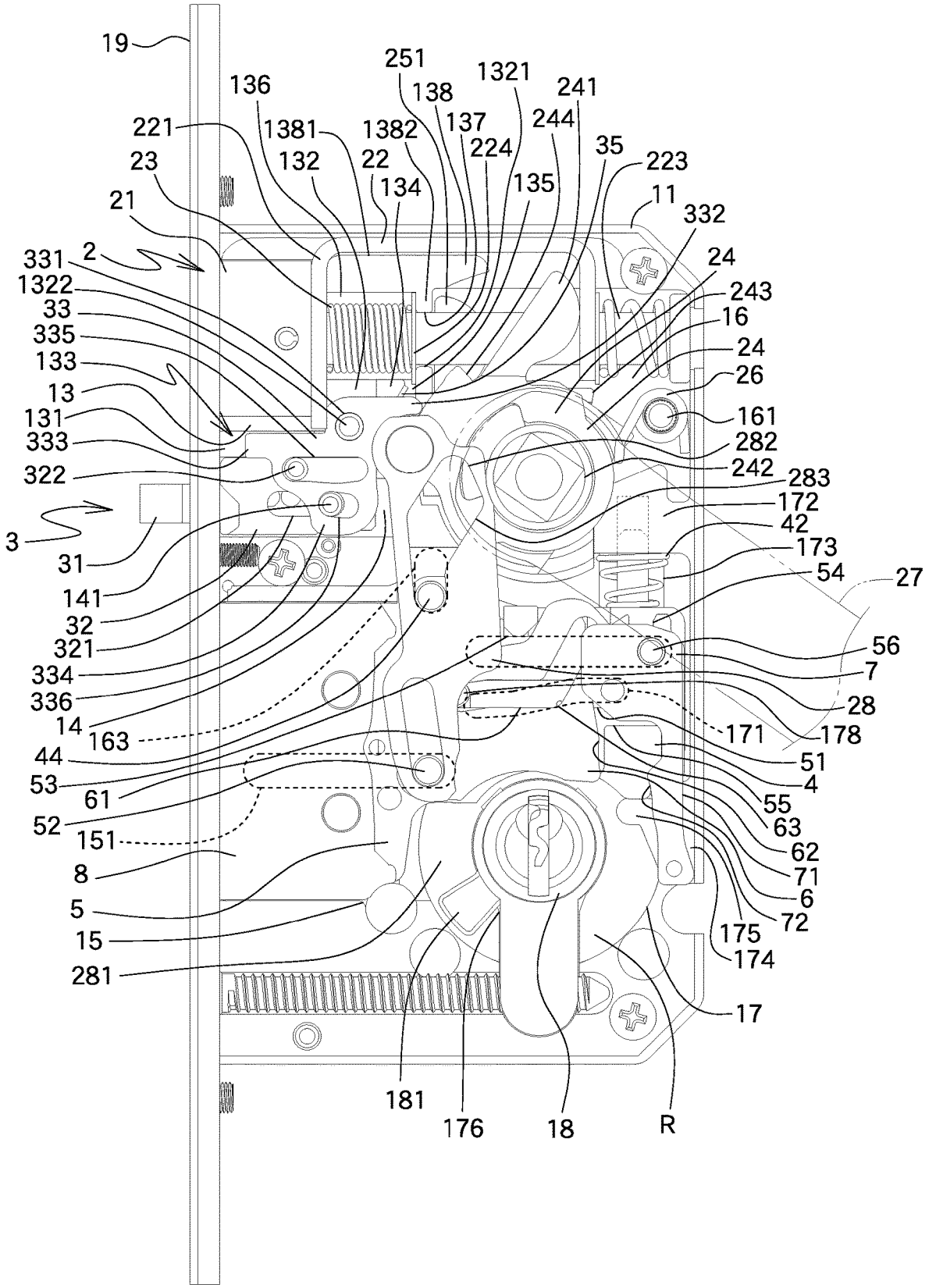
FIG. 21 shows the unlocked position and the opened position of the disclosure in FIG. 20.

As shown in FIG. 19 which shows the third embodiment of the present invention, wherein the differences between the first and third embodiments are that the restriction plate 4 includes a restriction part 44 that is installed to the existed restriction plate 4. The second part 12 has a longitudinal slot 163 in which the restriction part 44 slides. The transmission plate 28 includes an engaging recess 282 located corresponding to the restriction part 44. The restriction part 44 has a sufficient length so that the engaging recess 282 can mount to the restriction part 44. The engaging recess 282 has a space that is larger than the restriction part 44, and engaging recess 282 includes an inclined guide face 283 which is located corresponding to the position where the restriction part 44 compresses the resilient unit 42. In other words, the deadbolt 8 is located at the locked position, and the latch bolt 2 is located at the closed position. When the core 18 does not rotate the cam 181, the users can operate the handle 27 on the inside of the door to rotate the top rotation member 24 to rotate the closed position to the opened position. As shown in FIG. 20, the transmission plate 28 operates the restriction part 44 to drive the restriction plate 4 to compress the resilient unit 42 by the guide face 283. The restriction plate 4 moves to disengage the engaging member 43 from the second notch 54. The guide slot 281 pulls the second guide member 52 to move the deadbolt 8 to the unlocked position, and the latch bolt 2 moves to the opened position as shown in FIG. 21. The embodiment can be used on emergency doors so that the latch bolt 2 and the deadbolt 8 can be unlocked and opened by operating the handle on the inside of the door without using the key.

Besides, if the cam 181 is rotated by rotating the core 18, the lock can also be set to the unlocked position and the opened position.

It is noted that the function 6 can be combined with the functions 1 to 3, however, in one embodiment, the third embodiment can also be used with different type of case instead of the case 1 as disclosed.

Function 7: Locking the Handle 27 at the Locked Position.

Figure 22:
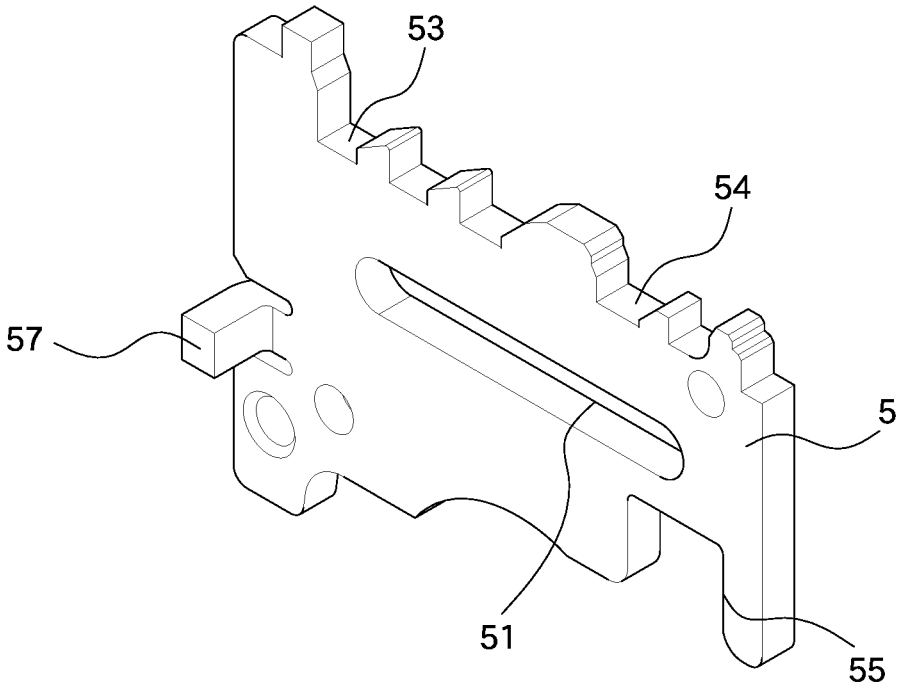
FIG. 22 shows another engaging member of the present invention.
Figure 23:
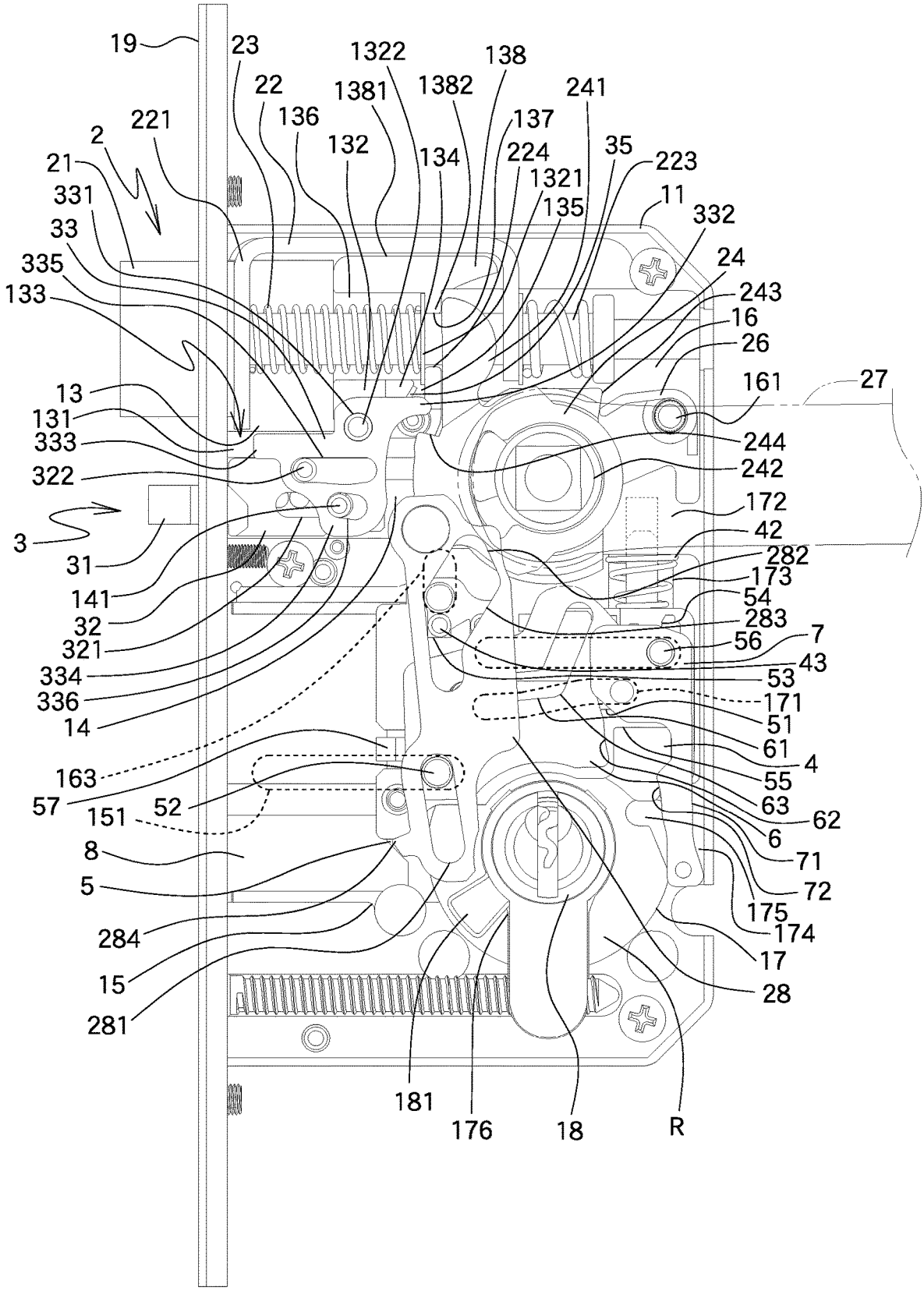
FIG. 23 is a right side view of the fourth embodiment of the present invention wherein the second part of the case is remove, and the lock is at the closed position.
Figure 24:
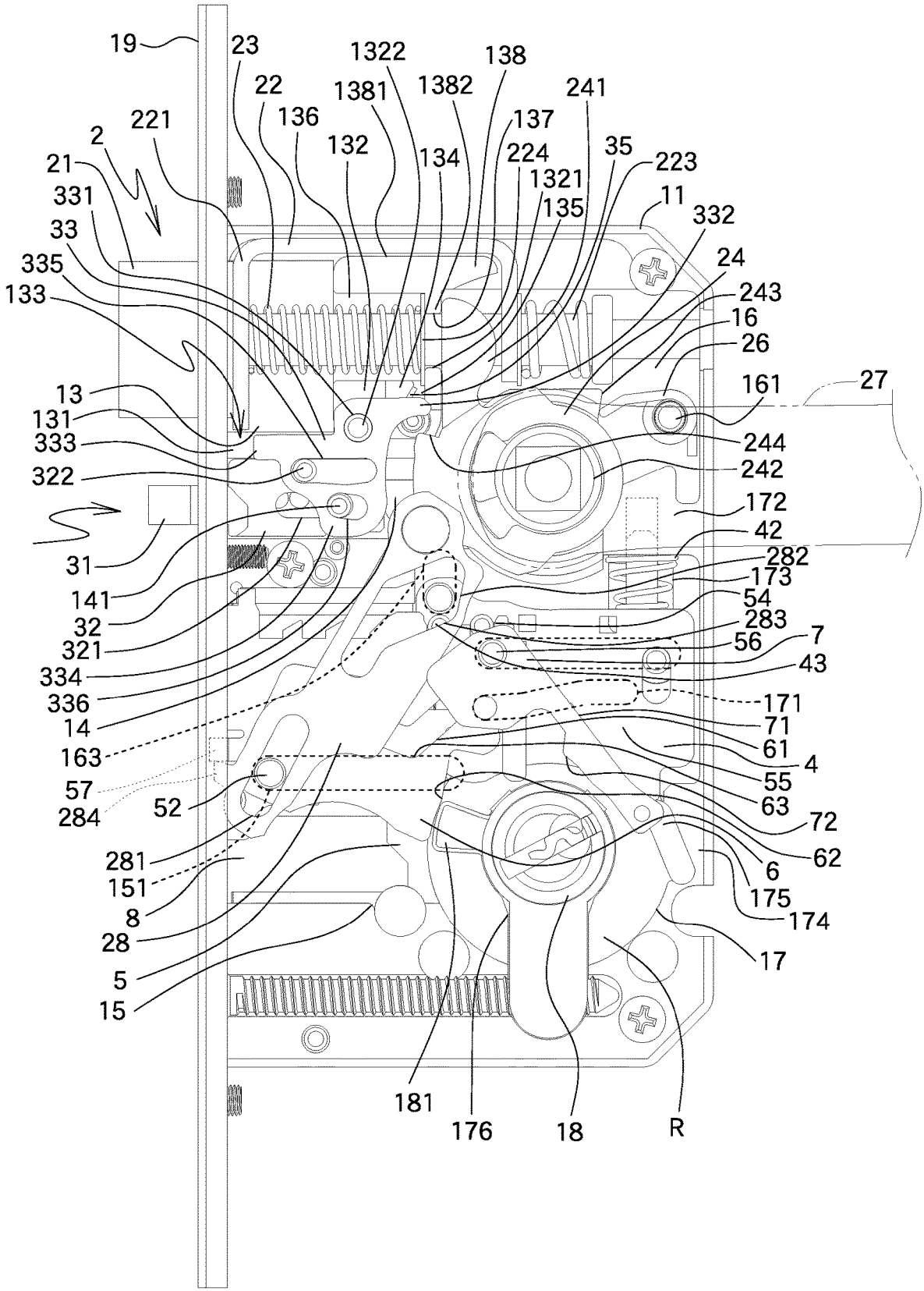
FIG. 24 shows that the lock in FIG. 23 is in the locked position.
Figure 25:
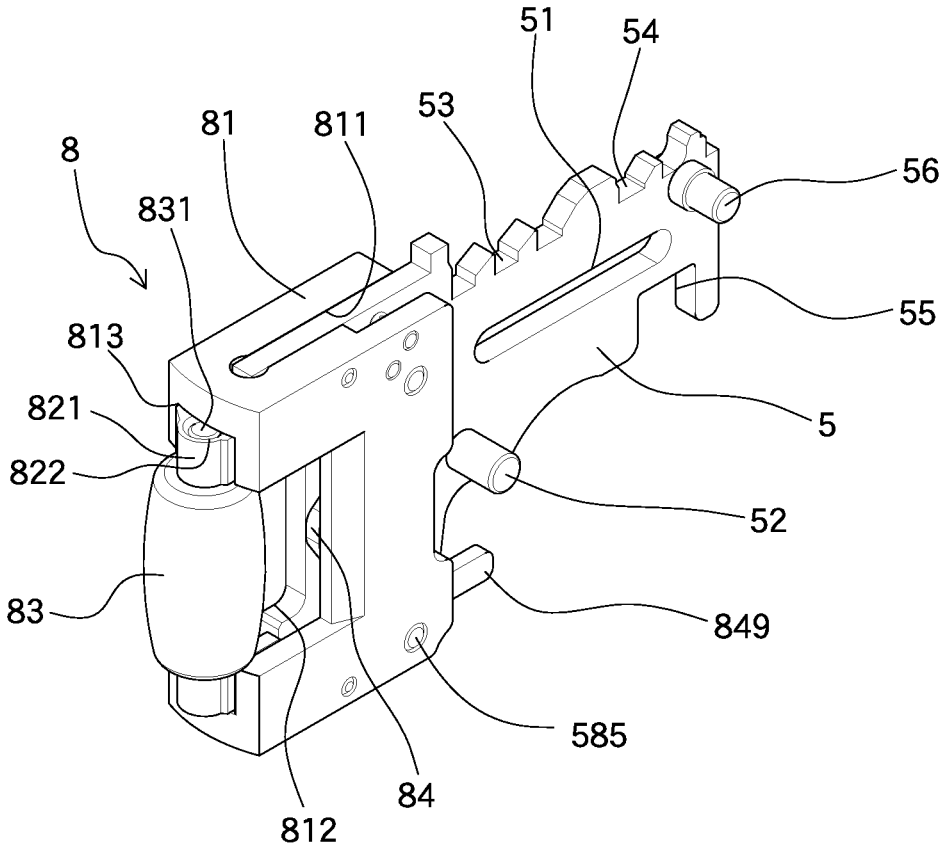
FIG. 25 shows the roller-type deadbolt in the fifth embodiment of the lock of the present invention.
Figure 26:
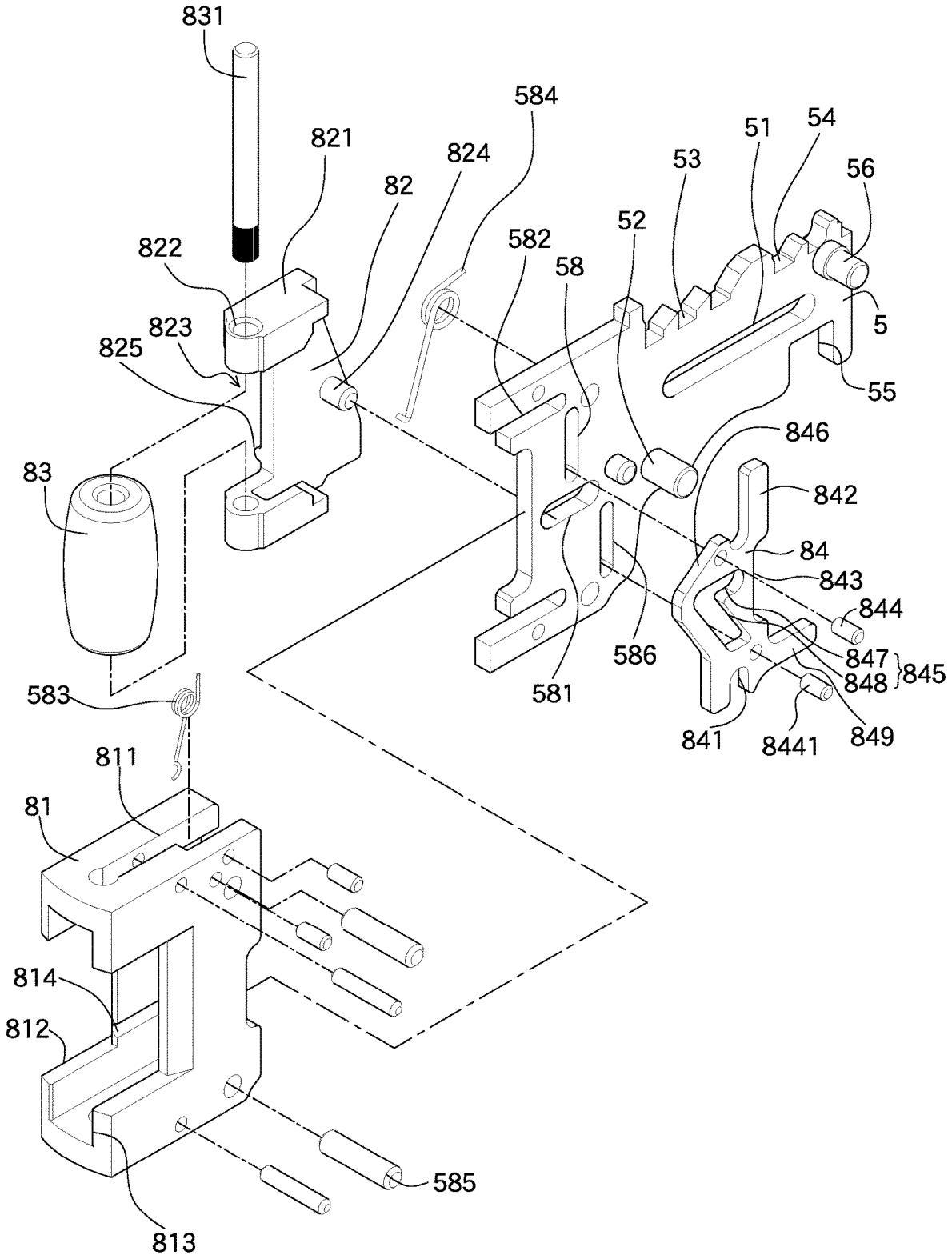
FIG. 26 is an exploded view of the disclosure of FIG. 25.

As shown in FIGS. 22 to 24, the fourth embodiment is disclosed, and the differences between the first and fourth embodiments are that the driving member 5 is not connected with the deadbolt 8, so that the embodiment cannot perform function 3. As shown in FIGS. 22, 23, the driving member 5 has a lug 57, and the transmission plate 28 has a protrusion 284 that is located corresponding to the lug 57. It is noted that in this embodiment, the handle 27 can only be installed to the top rotation member 24, and the installation hole 162 of the bottom rotation member 25 is closed. Alternatively, each of the top and bottom rotation members 24, 25 can be connected with a handle 27, and the two handles 27 have to be rotated simultaneously. As shown in FIG. 24, when in the locked position, the engaging member 43 is engaged with the second notch 54, and the protrusion 284 contacts the bottom of the lug 57 so that when trying to rotate the top rotation member 24, the top rotation member 24 is restricted by the protrusion 284 and the lug 57, and cannot be rotated. Even if there is a handle 27 installed to the outside of the door, because the two handles 27 are co-rotated, so that the latch bolt 2 cannot move to the opened position because the top rotation member 24 cannot be rotated. The only way is to rotate the cam 181 by the core 18 by moving the restriction plate 4 to disengage the engaging member 43 from the second notch 54, and to move the driving member 5 to the unlocked position to separate the protrusion 284 from the lug 57. Therefore, the latch bolt 2 can move to the opened position.

Function 8: Deadbolt 8 Having a Roller 83.

As shown in FIGS. 25 to 29, the fifth embodiment is disclosed, wherein the differences between the embodiments 1 and 5 are that the fifth embodiment can only perform functions 3 and 4, and cannot perform function 1 and 2. The deadbolt 8 includes a roller 83 and can be used for doors of storage rooms or plants. The deadbolt 8 including the roller 83 does not necessarily used in the case 1 as disclosed, different types of cases can also be used. This embodiment includes only the functions 3 and 4. The driving member 5 has a first slot 58 and a transverse slot 581. The driving member 5 includes two channels 582 defined in a distal end thereof. The driving member 5 is connected to a first spring 583, a second spring 584 and at least one positioning rod 585. The first spring 583 is located corresponding to the first slot 58.

The deadbolt 8 further includes a body 81, an insertion member 82, the roller 83 and a slide 84, wherein the body 81 has a fixing slot 811 to which a distal end of the driving member 5 is connected. The body 81 includes a receiving space 812 located opposite to one end of the driving member 5. The body 81 includes at least one fixing hole 813 which communicates with the fixing slot 811.

The insertion member 82 is received in the fixing hole 813 and includes two connection portions 821 which are respectively inserted into the channels 582. Each connection portion 821 has a through hole 822. An accommodating room 823 is formed between the two connection portions 821 so as to receive the roller 83 therein. A pin 831 extends through the roller 83, and two ends of the pin 831 are fixed with the two through holes 822. The insertion member 82 includes a guide rod 824 protruding therefrom which is located corresponding to the transverse slot 581. The second spring 584 biases the end face of the insertion member 82 that is located opposite to the roller 83. In order to allow the insertion member 82 to slide in the fixing slot 811 stably, the body 81 includes at least one guide way 814 defined in the inside of the fixing slot 811 and located at the path that the roller 83 moves between non-transmission position and transmission position. The insertion member 82 includes ridges 825 which slide on the guide ways 814.

The slide 84 is restricted by the positioning rods 585. In one embodiment, the slide 84 includes a first receiving notch 841 defined in the bottom thereof, and an extension portion 842 extending from the top thereof. A second receiving notch 843 is formed at the lower end of the extension portion 842. The positioning rods 585 are respectively engaged with the first receiving notch 841, the lateral side of the extension portion 842 that faces the roller 83, and the second receiving notch 843 at the non-transmission position. Therefore, the slide 84 can only be moved longitudinally.

The slide 84 includes a first guide pin 844 and a guide hole 845. The first guide pin 844 extends through the first slot 58. The slide 84 includes an inclined surface 846 so that the first spring 583 biases the inclined surface 846 so that the slide 84 is movable along the first slot 58. The guide hole 845 includes an extension slot 847 and an inclined slot 848. The extension slot 847 is located at the top end of the guide hole 845 and located corresponding to the transverse slot 581. The inclined slot 848 communicates with the extension slot 847 and inclinedly extends toward a direction away from the roller 83. The slide 84 has a transmission rod 849 extending toward a direction away from the roller 83, and the transmission rod 849 is located at the rail "R" when the lock is at the unlocked position.

In order to balance the movement of the slid 84, the driving member 5 has a second slot 586 which is located corresponding to the first slot 58. The slide 84 has a second guide pin 8441 which is movable in the second slot 586.

Figure 27:
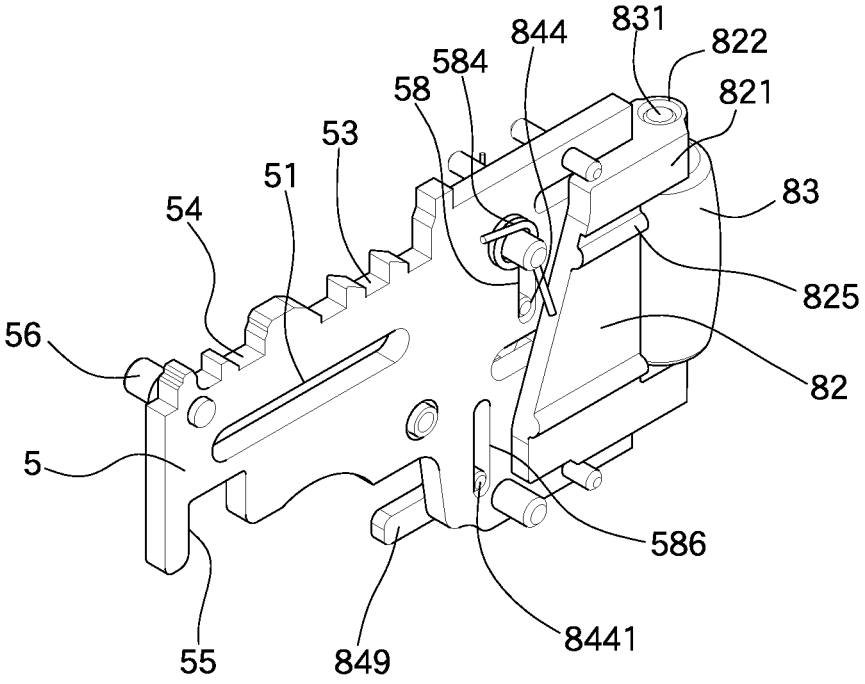
FIG. 27 shows that the body in FIG. 25 is removed.
Figure 28:
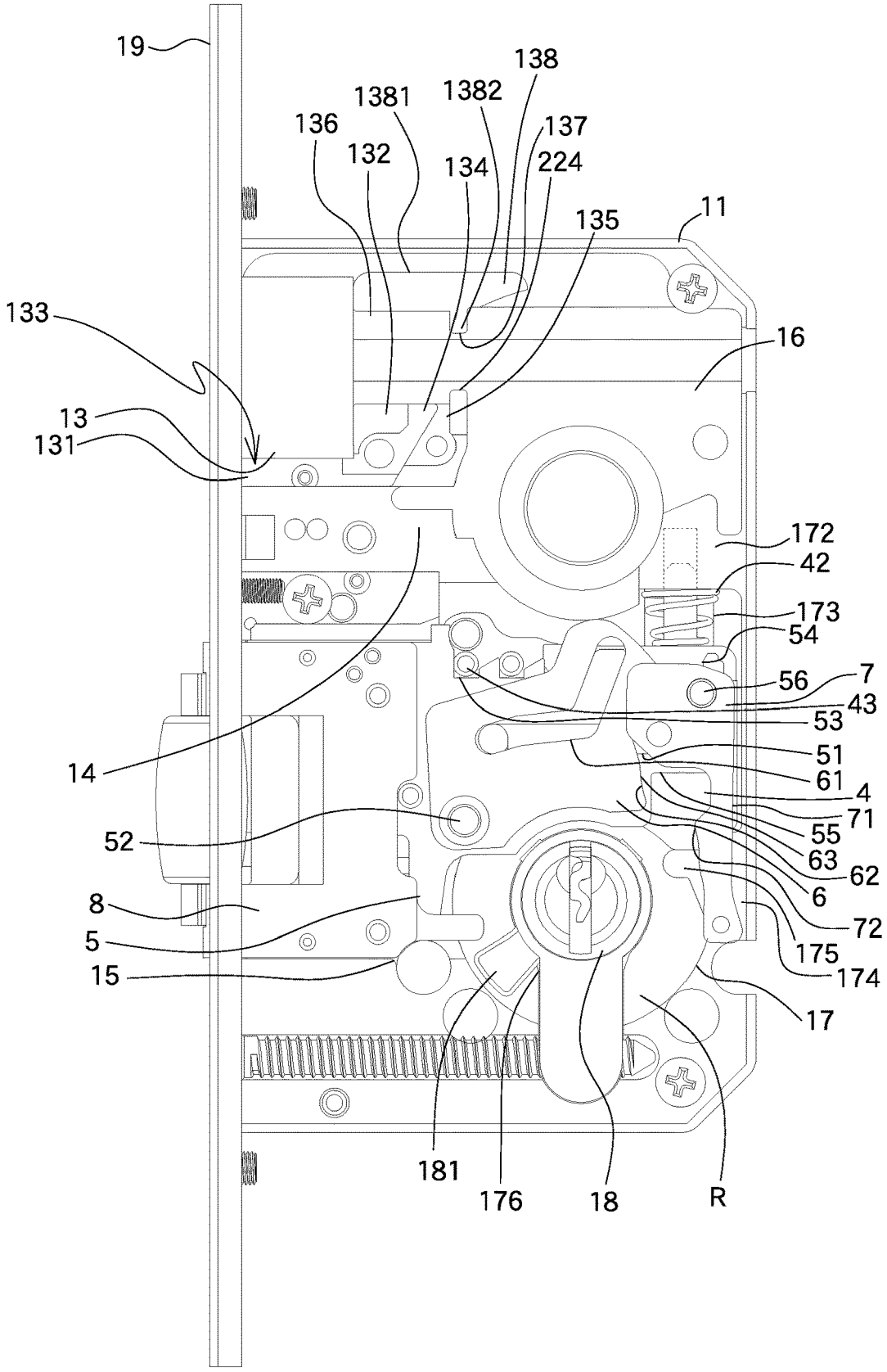
FIG. 28 shows the right side view of the fifth embodiment of the present invention, wherein the second part of the case is removed, and the lock is at the unlocked position and the non-transmission position.
Figure 29:
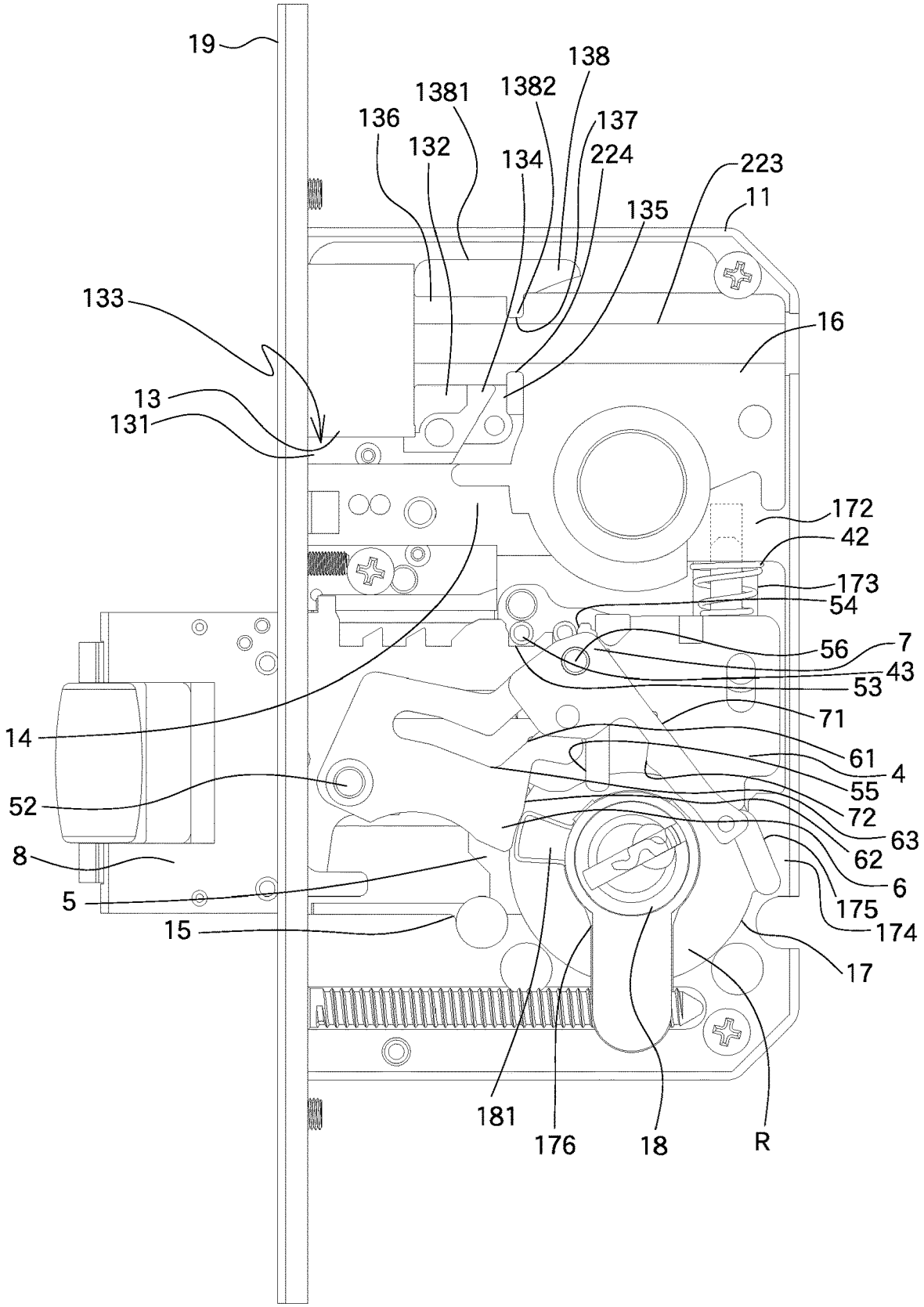
FIG. 29 is a right side view of the locked position of the lock of FIG. 28.
Figure 30:
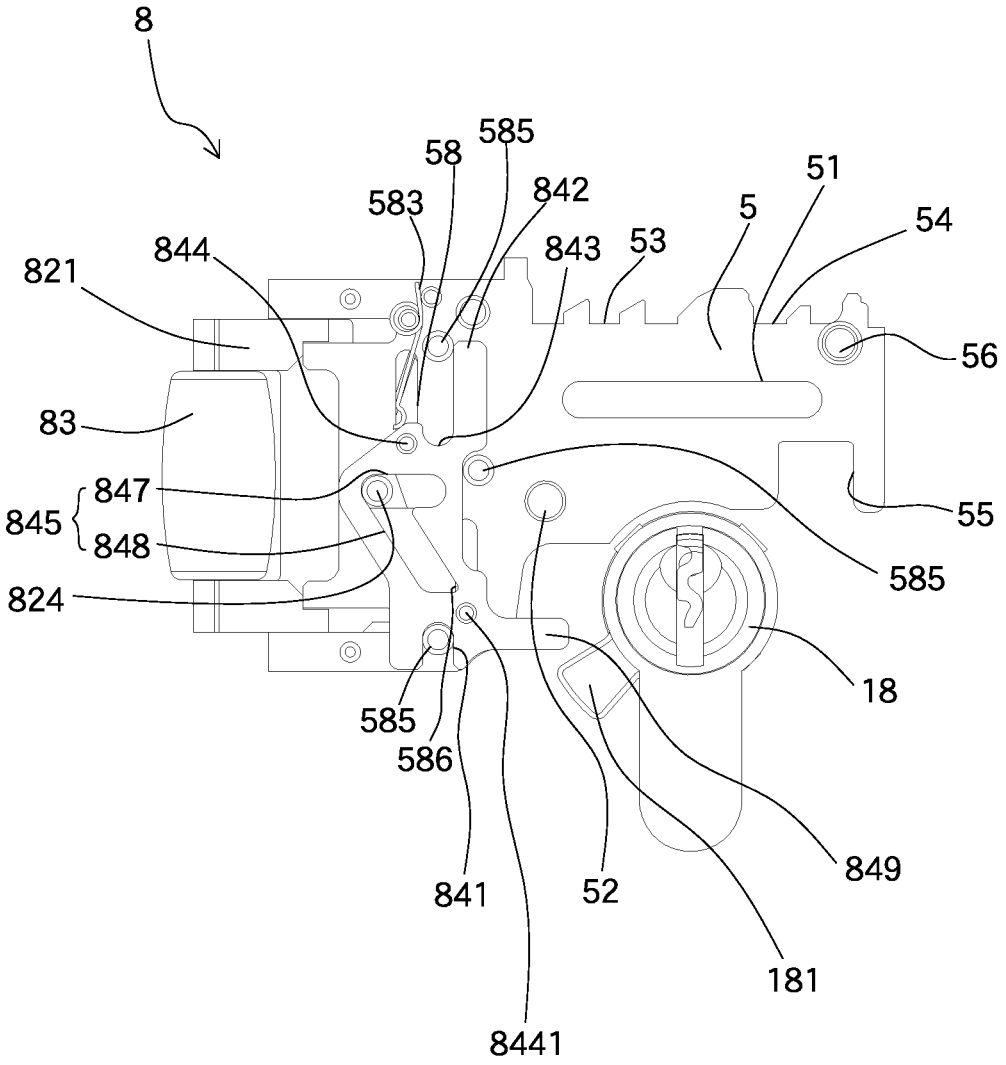
FIG. 30 is a right side view to show that the engaging member, the deadbolt and the core are located at the transmission position in the fifth embodiment of the present invention.
Figure 31:
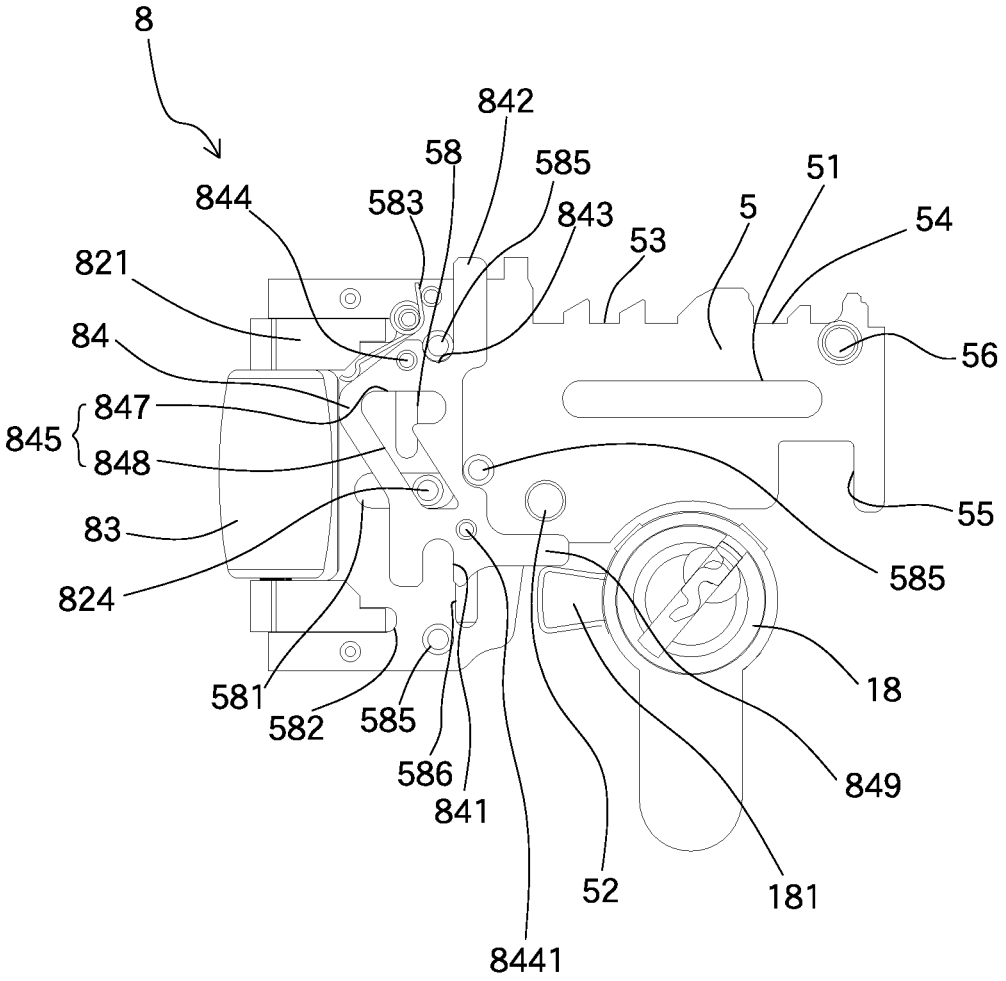
FIG. 31 is a right side view to show that the engaging member, the deadbolt and the core are located at the non-transmission position in the fifth embodiment of the present invention.

As shown in FIGS. 28 and 29, when the deadbolt 8 is located at the locked position or the unlocked position, the deadbolt 8 is able to perform the function 3. When in the non-transmission position, as shown in FIGS. 28 and 30, the slide 84 is biased by the first spring 583 so that the first guide pin 844 is located the inner bottom end of the first slot 58. The insertion member 82 is biased by the second spring 584 and the roller 83 protrudes beyond the receiving space 812. When in the transmission position, as shown in FIG. 31, only the driving member 5, the deadbolt 8 and the core 18 are disclosed for clarity purpose, the transmission rod 849 is pushed by the cam 181 so that the slide 84 and the inclined slot 848 move toward the top of the first slot 58. The guide rod 824 contacts the inclined slot 848 to drive the slide 84 and the roller 83 to move along the transverse slot 581 and toward a direction opposite to the roller 83. Therefore, the roller 83 does not protrude beyond the receiving space 812. The purpose is that when in the unlocked position as shown in FIG. 27, the roller 83 partially protrudes beyond the case 1 so that by rotating the cam 181 clockwise to move the transmission rod 849, the roller 83 does not protrude beyond the case 1 so that the door can be opened and closed. Because in the non-transmission position, insertion member 82 is not restricted, and is only biased by the second spring 584 to press the roller 83 along a direction perpendicular to the axis of the roller 83, and this also makes the roller 83 be moved into the receiving space 812. Therefore, by a force applied to the door, the door can be opened or closed.

Figure 32:
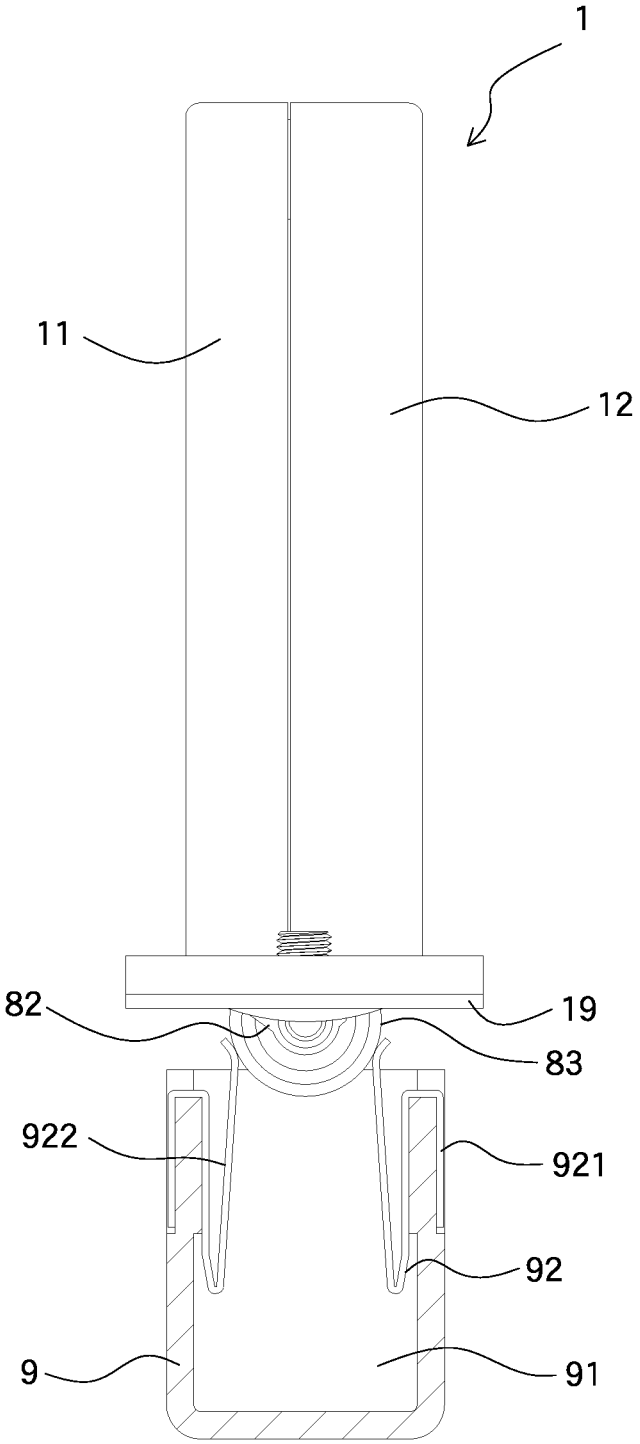
FIG. 32 is a top view of the disclosure of the fifth embodiment of the present invention.

As shown in FIG. 32, for the receiving box 9 installed to the door frame, the receiving box 9 includes a receiving hole 91 that is located corresponding to the deadbolt 8. The receiving hole 91 includes two resilient members 92 received therein. Each receiving member 92 includes an installation portion 921 and a holding portion 922. The installation portion 921 is connected to the wall of the receiving hole 91, and the holding portion 922 is a bent portion and extends toward the opening of the receiving hole 91. A holding room is defined between the two holing portions 922 and located corresponding to the roller 83 and the deadbolt 8. When the door is opened, the roller 83 is stopped by the holding portions 922 so that the roller 83 is not retracted into the receiving room 812, so that the door cannot be closed. When the door is closed, by operating the core 18, the roller 83 is retracted into the receiving space 812, so that the roller 83 is not affected by the holding portions 922 and is successfully closed.

Figure 33:
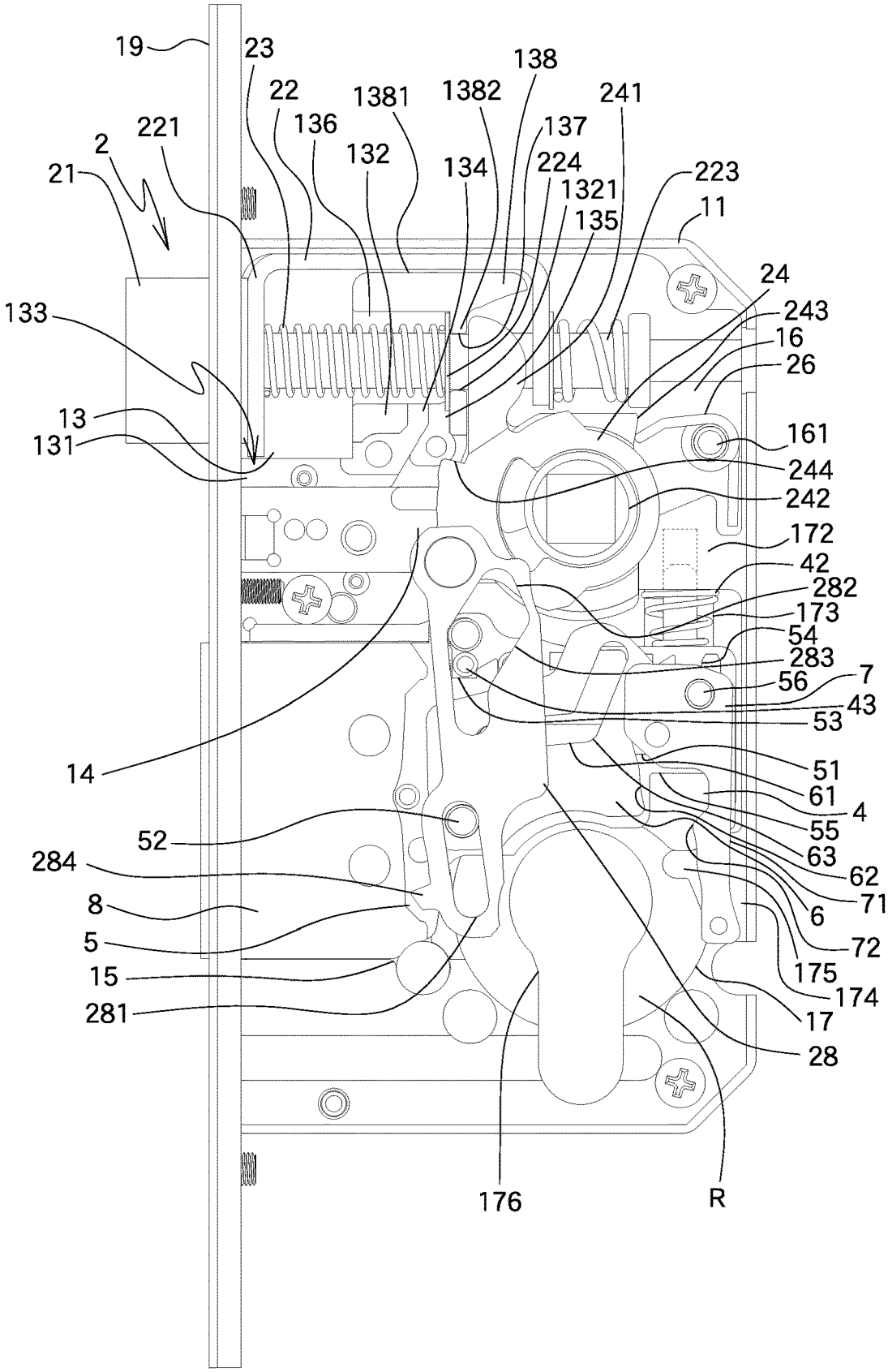
FIG. 33 is a right side view of the sixth embodiment of the present invention, wherein the second part of the case is removed.
Figure 34:
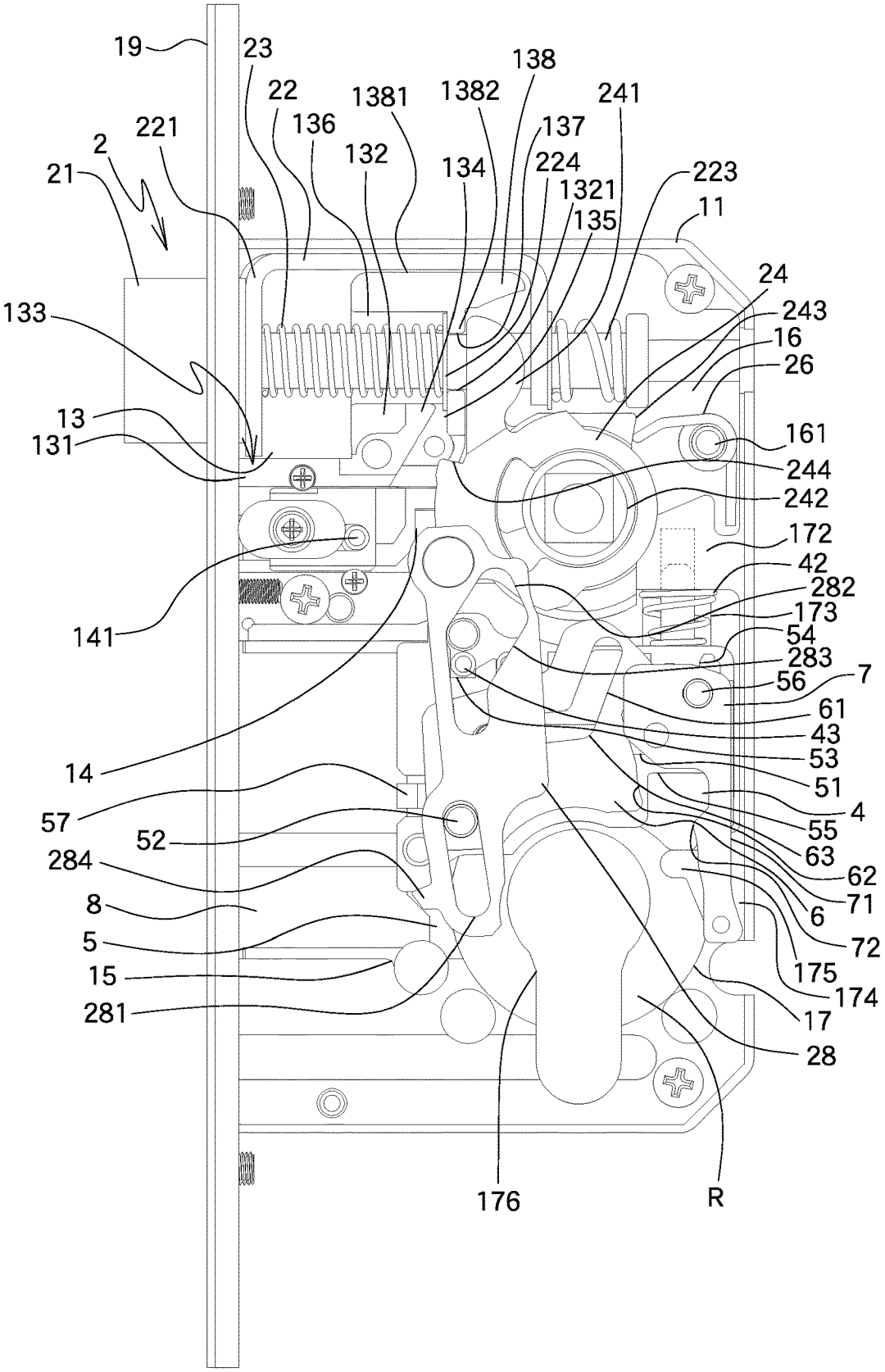
FIG. 34 is a right side view of the seventh embodiment of the present invention, wherein the second part of the case is removed.
Figure 35:
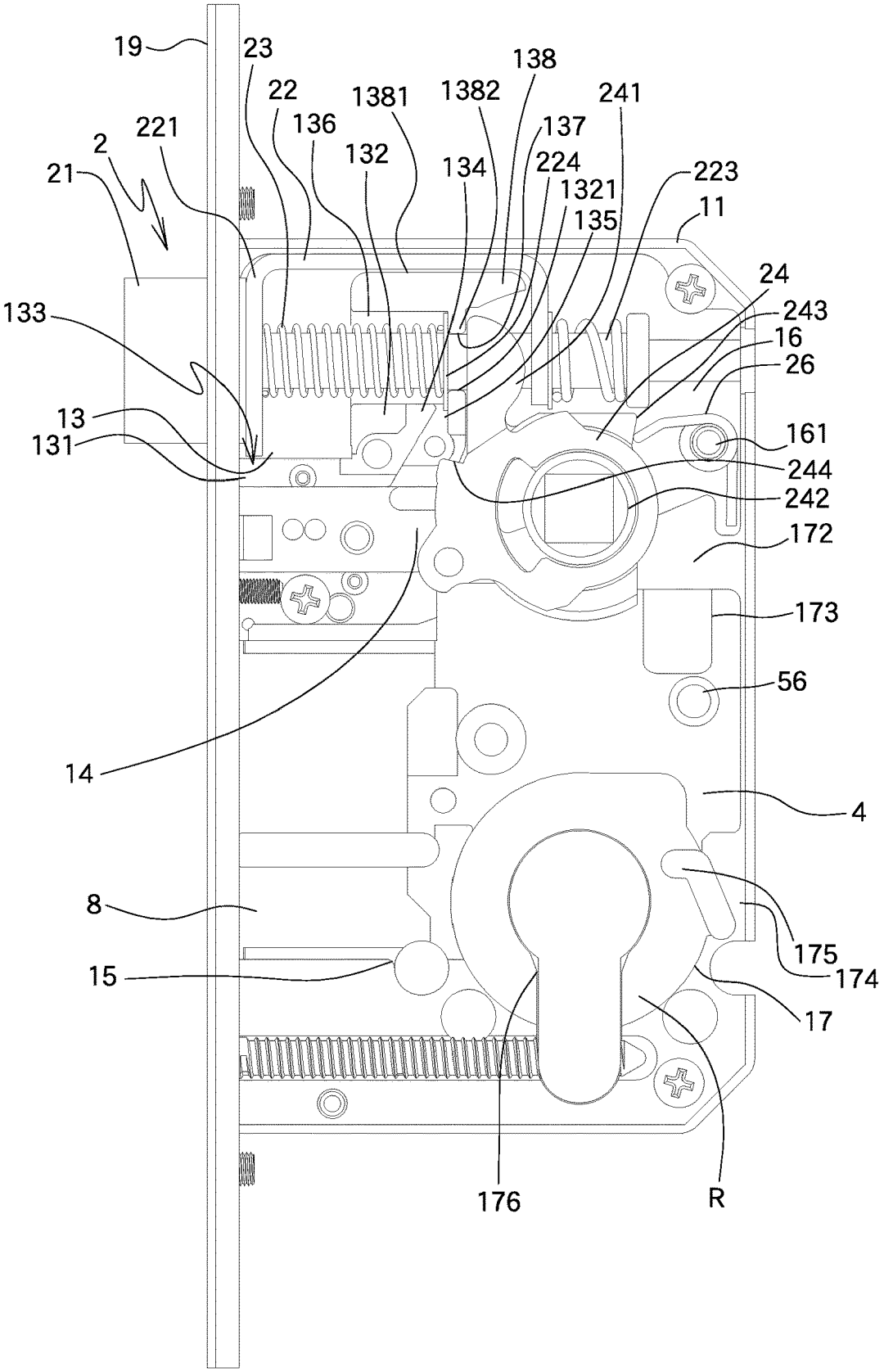
FIG. 35 is a right side view of the eighth embodiment of the present invention, wherein the second part of the case is removed.
Figure 36:
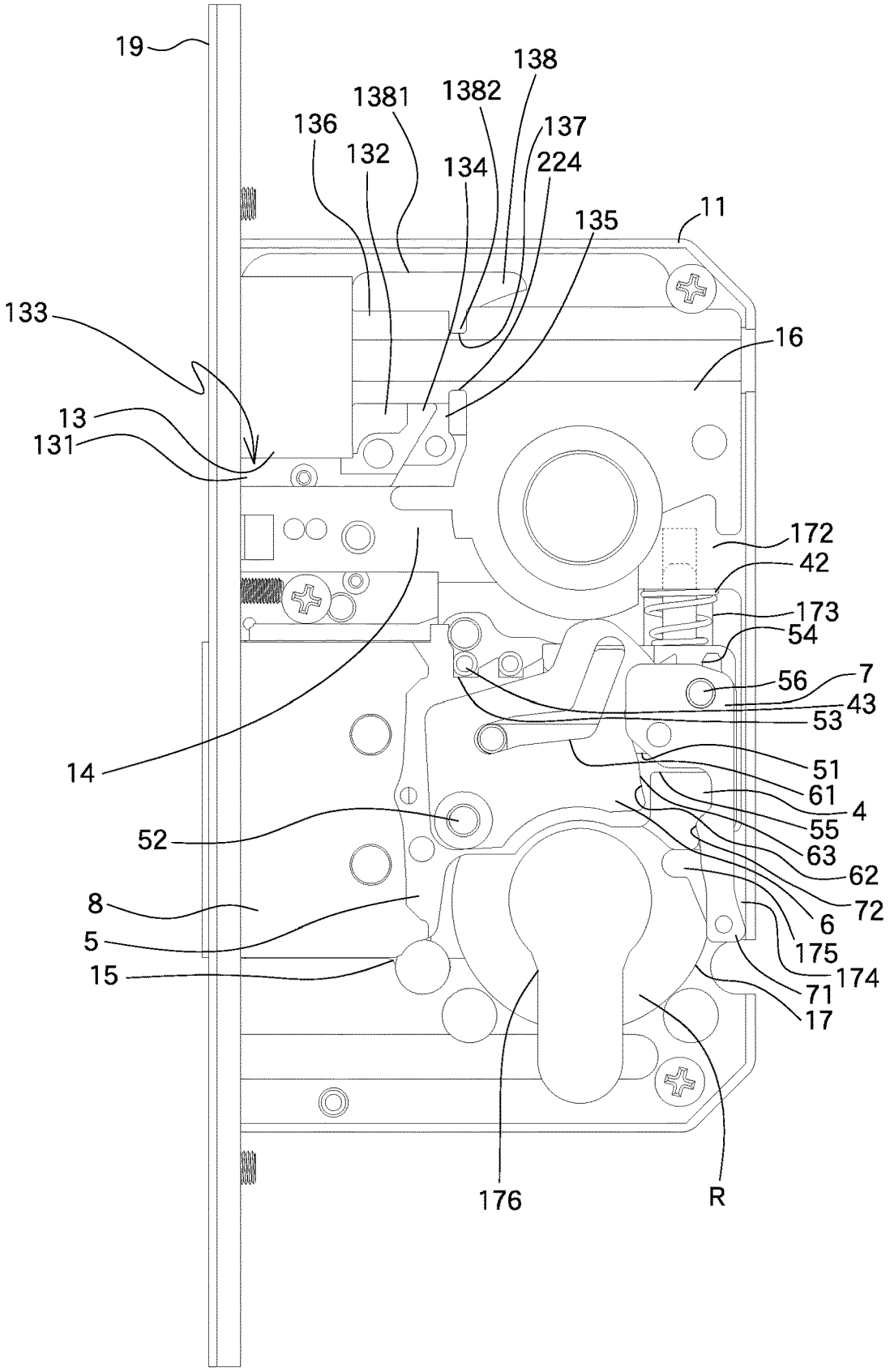
FIG. 36 is a right side view of the ninth embodiment of the present invention, wherein the second part of the case is removed.

The lock may have at least one of the functions 1 to 8 according to practical needs, and can be used in different locations. For example, as shown in FIG. 33 which discloses the sixth embodiment, and can perform functions 1 and 5 so that the lock can be used on bathroom doors. As shown in FIG. 34 which discloses the seventh embodiment, and can perform functions 1, 5 and 7 so that the lock can be used on room doors. As shown in FIG. 35 which discloses the eighth embodiment, and can perform function 1 so that the lock can be used on bathroom doors, kitchen doors and hallway doors. The portion that does not have the core hole 176 can be sealed by inserting a seal member (not shown). As shown in FIG. 36 which discloses the ninth embodiment, and can perform function 3 so that the lock can be used on storage room doors.

While we have shown and described the embodiment in accordance with the present invention, it should be clear to those skilled in the art that further embodiments may be made without departing from the scope of the present invention.

What is claimed is:

1. A lock with a roller deadbolt, comprising:

a driving member (5) having a first slot (58) and a transverse slot (581), the driving member (5) including two channels (582) defined in a distal end thereof, the driving member (5) connected to a first spring (583), a second spring (584) and at least one positioning rod (585), the first spring (583) located corresponding to the first slot (58);

a deadbolt (8) including a body (81), an insertion member (82), a roller (83) and a slide (84);

the body (81) having a fixing slot (811) to which a distal end of the driving member (5) is connected, the body (81) including a receiving space (812) located opposite to one end of the driving member (5), the body (81) including at least one fixing hole (813) which communicates with the fixing slot (811);

the insertion member (82) received in the fixing hole (813) and including two connection portions (821) which are respectively inserted into the channels (582), an accommodating room (823) formed between the two connection portions (821) so as to receive the roller (83) therein, a pin (831) extending through the roller (83), and two ends of the pin (831) fixed with the two through holes (822), the insertion member (82) including a guide rod (824) protruding therefrom which is located corresponding to the transverse slot (581), the second spring (584) biasing an end face of the insertion member (82) that is located opposite to the roller (83), and the slide (84) being restricted by the positioning rods (585), the slide (84) including a first guide pin (844) and a guide hole (845), the first guide pin (844) extends through the first slot (58), the slide (84) including an inclined surface (846), the first spring (583) biasing the inclined surface (846) so that the slide (84) is movable along the first slot (58), the guide hole (845) including an extension slot (847) and an inclined slot (848), the extension slot (847) located at the top end of the guide hole (845) and located corresponding to the transverse slot (581), the inclined slot (848) communicates with the extension slot (847) and inclinedly extending toward a direction away from the roller (83), the slide (84) having a transmission rod (849) extending toward a direction away from the roller (83), when in a non-transmission position, the slide (84) is biased by the first spring (583) so that the first guide pin (844) is located an inner bottom end of the first slot (58), the insertion member (82) is biased by the second spring (584) and the roller (83) protrudes beyond the receiving space (812), when in the transmission position, the transmission rod (849) is pushed so that the slide (84) and the inclined slot (848) move toward the top of the first slot (58), the guide rod (824) contacts the inclined slot (848) to drive the slide (84) and the roller (83) to move along the transverse slot (581) and toward a direction opposite to the roller (83), the roller (83) does not protrude beyond the receiving space (812).

2. The lock as claimed in claim 1, wherein the driving member (5) has a second slot (586) which is located corresponding to the first slot (58), the slide (84) has a second guide pin (8441) which is movable in the second slot (586).

3. The lock as claimed in claim 1, wherein the slide (84) includes a first receiving notch (841) defined in a bottom thereof, an extension portion (842) extends from a top of the slide (84), a second receiving notch (843) is formed at a lower end of the extension portion (842), the at least one positioning rod (585) is engaged with the first receiving notch (841), the at least one positioning rod (585) is located at the first receiving notch (841), a lateral side of the extension portion (842) that faces the roller (83), and the second receiving notch (843) when in the non-transmission position.

4. The lock as claimed in claim 1, wherein the fixing slot (811) includes at least one guide way (814) which is located at a path that the roller (83) moves between the non-transmission position and the transmission position, the insertion member (82) includes ridges (825) which slide on the at least one guide way (814).

5. The lock as claimed in claim 1 further comprising a case (1) which includes a core recess (17) and a deadbolt recess (15), the core recess (17) including a first guide member (178) and defining a loop-shaped rail (R), the transmission rod (849) located at the rail (R) when the deadbolt (8) does not protrudes beyond the deadbolt recess (15), the deadbolt (8) being movable in the deadbolt recess (15), the driving member (5) including a third notch (55) defined in an end thereof, the transmission rod (849) and the third notch (55) located at the loop-shaped rail (R).

6. The lock as claimed in claim 5, wherein the core recess (17) includes the first guide member (178), a restriction plate (4) and a stop plate (8), an underside of the restriction plate (4) is located at the rail (R), the restriction plate (4) includes a first guide hole (41), and the first guide member (178) extends through the first guide hole (41), the case (1) includes a third positioning wall (172) which includes a second positioning portion (173) formed on an underside thereof, a resilient unit (42) is biased between the restriction plate (4) and the third positioning wall (172), the resilient unit (42) is connected to the second positioning portion (173), and a resilient direction of the resilient unit (42) is correspondent to the first guide hole (41), the restriction plate (4) includes at least one engaging member (43), the driving member (5) has a slide slot (51) in which the first guide member (178) is slidably received therein, the driving member (5) includes a third guide member (56) on one end face thereof, the driving member (5) includes a first notch (53) and a second notch (54) defined in a top thereof, the first and second notches (53, 54) are located corresponding to the at least one engaging member (43), the stop plate (7) is pivotably connected to the third guide member (56) and includes an extension portion (71) which includes a corner (72), the extension portion (71) includes a rod (73) which is slidable in an elongate groove (175) defined in an end face of the case (1), the corner (72) is removed from the rail (R), when in a locked position, the deadbolt (8) protrudes beyond the deadbolt recess (15), the first guide member (178) is located in an end of the slide slot (51) and located opposite to the deadbolt (8), the rod (73) is located at a top inner end of the elongate groove (175), the engaging member (43) is engaged with the second notch (54), when in an unlocked position, the deadbolt (8) is located in the deadbolt recess (15), the roller (83) protrudes beyond the deadbolt recess (15), the first guide member (178) is located is located in another end of the slide slot (51), the rod (73) is located at a bottom inner end of the elongate groove (175), the engaging member (43) is engaged with the first notch (53).

7. The lock as claimed in claim 6 further comprising an extension plate (6) which has an end thereof pivotably connected to the second guide member (52), the extension plate (6) including an extension slot (61) which extends toward two opposite extension directions which are located corresponding to the slide slot (51), the first guide member (178) being slidable within the extension slot (61), the extension plate (8) located at the rail (R).

8. The lock as claimed in claim 6, wherein the core recess (17) includes a core (18) received therein, the core (18) has a cam (181) which is rotatable along the rail (R).

9. The lock as claimed in claim 6 further comprising a receiving box (9) which includes a receiving hole (91) that is located corresponding to the deadbolt (8), the receiving hole (91) including two resilient members (92) received therein, each receiving member (92) including an installation portion (921) and a holding portion (922), the installation portion (921) connected to a wall of the receiving hole (91), and the holding portion (922) being a bent portion extending toward an opening of the receiving hole (91), a holding room being defined between the two holing portions (922) and located corresponding to the roller (83) and the deadbolt (8).

* * * * *